US008083343B2

(12) United States Patent
Ikuno et al.

(10) Patent No.: US 8,083,343 B2
(45) Date of Patent: Dec. 27, 2011

(54) RECORDING MATERIAL AND RECORDING APPARATUS

(75) Inventors: Masaya Ikuno, Kanagawa (JP); Satoshi Mohri, Kanagawa (JP); Hiroshi Ikeda, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 413 days.

(21) Appl. No.: 12/370,707

(22) Filed: Feb. 13, 2009

(65) Prior Publication Data

US 2010/0073448 A1 Mar. 25, 2010

(30) Foreign Application Priority Data

Sep. 25, 2008 (JP) ..... 2008-246729

(51) Int. Cl.
*B41J 2/01* (2006.01)

(52) U.S. Cl. ..... 347/105; 347/101

(58) Field of Classification Search ..... 347/105, 347/101, 103, 102, 95, 96, 100; 428/195, 428/32.1

See application file for complete search history.

(56) References Cited

U.S. PATENT DOCUMENTS

| | | | | |
|---|---|---|---|---|
| 6,245,382 | B1 * | 6/2001 | Shvartsman et al. | 427/208.2 |
| 7,604,338 | B2 * | 10/2009 | Ikeda et al. | 347/100 |
| 2004/0026017 | A1 * | 2/2004 | Taylor et al. | 156/230 |
| 2004/0029030 | A1 * | 2/2004 | Murray | 428/483 |
| 2006/0061641 | A1 | 3/2006 | Ueki et al. | |
| 2006/0286315 | A1 * | 12/2006 | Hashimoto et al. | 428/32.34 |
| 2008/0136892 | A1 | 6/2008 | Doi et al. | |

FOREIGN PATENT DOCUMENTS

| | | |
|---|---|---|
| JP | 2001-150792 | 6/2001 |
| JP | 2006-082461 | 3/2006 |
| JP | 2006-347085 | 12/2006 |
| JP | 2008-142924 | 6/2008 |

* cited by examiner

*Primary Examiner* — Manish S Shah
(74) *Attorney, Agent, or Firm* — Fildes & Outland, P.C.

(57) ABSTRACT

According to an aspect of the invention and there is provided a recording material having an ink, ink absorbing particles that absorb the ink, and a curable liquid that cures the substantial surface of the ink absorbing particles.

4 Claims, 8 Drawing Sheets

RECORDING MATERIAL AND RECORDING APPARATUS

CROSS-REFERENCE TO RELATED APPLICATIONS

This application is based on and claims priority under 35 USC 119 from Japanese Patent Application No. 2008-246729 filed on Sep. 25, 2008.

BACKGROUND

1. Technical Field

The present invention relates to a recording material and a recording apparatus.

2. Related Art

In a recording system utilizing ink, in order to record on various recording media such as liquid permeable media or liquid impermeable media, there has been proposed a method, in which after ink impinges on an intermediate transfer member, on which ink absorbing particles are dispersed, the ink is transferred onto a recording medium.

SUMMARY

According to an aspect of the invention, there is provided a recording material containing an ink, ink absorbing particles that absorb the ink, and a curable liquid that cures the substantial surface of the ink absorbing particles.

BRIEF DESCRIPTION OF THE DRAWINGS

Exemplary embodiments of the present invention will be described in detail based on the following figures, wherein.

DETAILED DESCRIPTION

Figure 1:
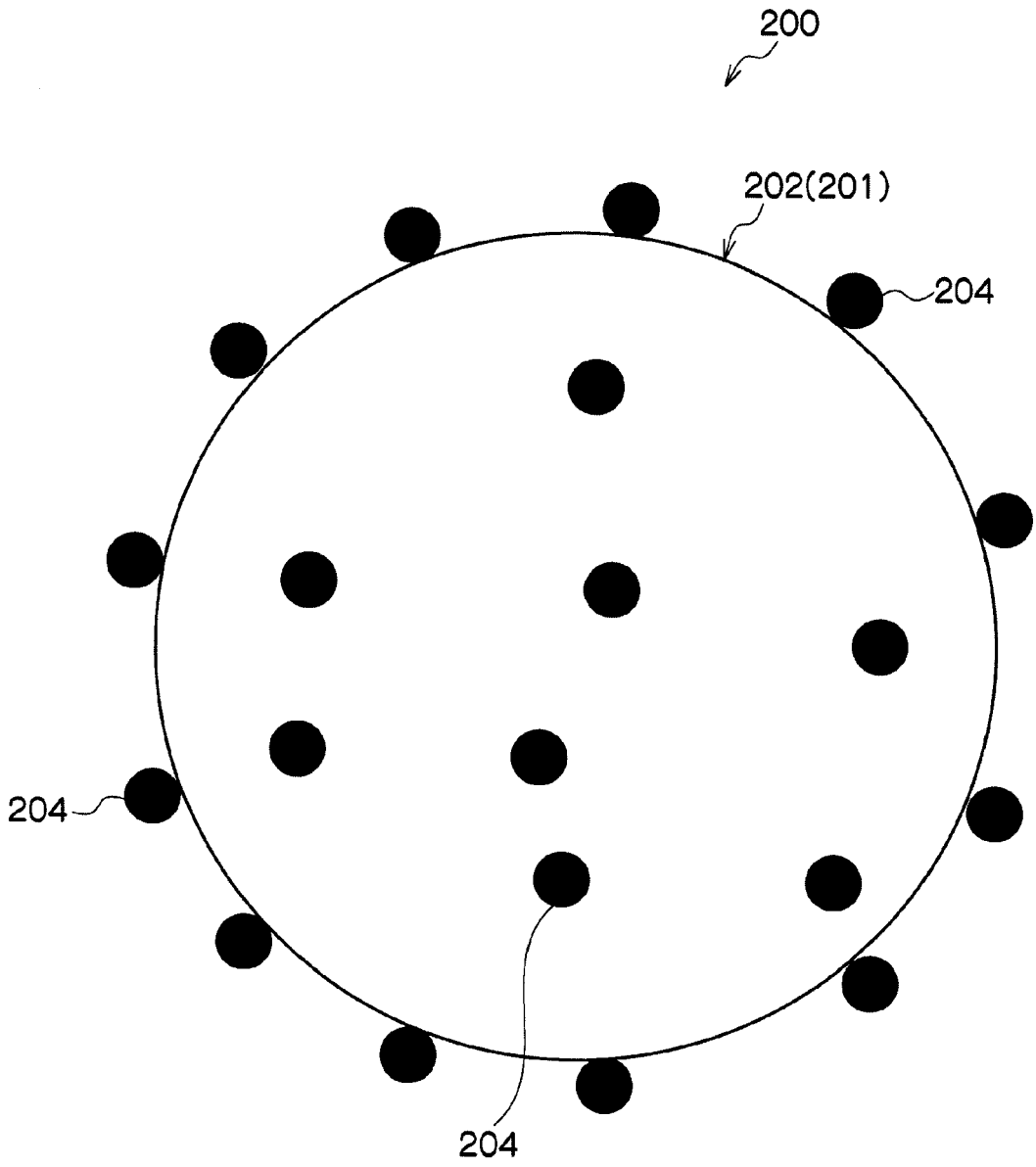
FIG. 1 is a schematic drawing showing an example of ink absorbing particles according to a first exemplary embodiment.

Hereinafter, as preferable embodiments, a recording material according to a first exemplary embodiment, and recording apparatuses according to a second exemplary embodiment and a third exemplary embodiment will be explained in detail.

A recording material according to a first exemplary embodiment comprises ink, ink absorbing particles for receiving the ink, and a curable liquid that cures the substantial surface of the ink absorbing particles.

Further, the recording apparatus according to the second exemplary embodiment comprises an intermediate transfer member, an ink absorbing particle supplying unit that supplies the ink absorbing particles in the recording material according to the first exemplary embodiment onto the intermediate transfer member, an ink ejecting unit that ejects ink in the recording material according to the first exemplary embodiment onto the ink absorbing particles supplied onto the intermediate transfer member, a transfer unit that transfers the ink absorbing particles that absorbed the ink onto a recording medium, a fixing unit that fixes the ink absorbing particles that absorbed the ink transferred to the recording medium, and a curable liquid application unit that applies the curable liquid in the recording material according to the first exemplary embodiment to the ink absorbing particles which have received the ink. In the recording apparatus according to the second exemplary embodiment, the curable liquid application unit applies the curable liquid to the ink absorbing particles in at least one of the following (a)-(c);

(a) after the ink is ejected to the ink absorbing particles from the ink ejecting unit, and before the ink absorbing particles that absorbed the ink are transferred to the recording medium by the transfer unit;

(b) after the ink absorbing particles that absorbed the ink are transferred to the recording medium by the transfer unit, and before the ink absorbing particles that absorbed the ink are fixed onto the recording medium by the fixing unit; and (c) after the ink absorbing particles that absorbed the ink are fixed onto the recording medium by the fixing unit.

Furthermore, a recording apparatus according to the third exemplary embodiment contains an ink absorbing particle supplying unit that supplies ink absorbing particles in the recording material according to the first exemplary embodiment onto a recording medium, an ink ejecting unit that ejects the ink in the recording material according to the first exemplary embodiment onto the ink absorbing particles supplied onto the recording medium, a fixing unit that fixes the ink absorbing particles that absorbed the ink supplied onto the recording medium, and a curable liquid application unit that applies the curable liquid in the recording material according to the first exemplary embodiment to the ink absorbing particles which have received the ink. In the recording apparatus according to the third exemplary embodiment, the curable liquid application unit applies the curable liquid to the ink absorbing particles in at least one of the following (d)-(e);

(d) after the ink is ejected to the ink absorbing particles from the ink ejecting unit, and before the ink absorbing particles that absorbed the ink are fixed onto the recording medium by the fixing unit; and (e) after the ink absorbing particles that absorbed the ink are fixed onto the recording medium by the fixing unit.

The inventors have studied on the durability (in particular, scratch resistance and water resistance) of an image in a recording system in which the image is formed by fixing the ink absorbing particles, after ink droplets attach to ink absorbing particles. As a result, it has been found that it is effective to apply a curable liquid having a function for curing the substantial surface of the ink absorbing particles to the ink absorbing particles, after the ink droplets attach to the ink absorbing particles.

More specifically, in the second exemplary embodiment, first, an ink absorbing particle layer is formed by supplying ink absorbing particles onto an intermediate transfer member from an ink absorbing particle supplying unit, and ink is ejected from an ink ejecting unit onto the ink absorbing particle layer, thereafter, a curable liquid is applied to the ink absorbing particle layer, on the timing of (a)-(c). Accordingly, it is presumed that the surface of the ink absorbing particle layer is cured, and the durability of an image thus formed can be improved. Moreover, in the third exemplary embodiment, first, ink absorbing particles are supplied from an ink absorbing particle supplying unit onto a recording medium to form an ink absorbing particle layer, and after ink is ejected from an ink ejecting unit onto the ink absorbing particle layer, a curable liquid is applied to the ink absorbing particle layer on the timing of (d)-(e). Accordingly, it is presumed that the surface of the ink absorbing particle layer is cured, and the durability of an image thus formed can be improved.

As a method of curing the substantial surface of ink absorbing particles, although the method is not specifically limited, a method of forming a cross-linked structure at the substantial surface of the ink absorbing particles by applying a curable liquid to the ink absorbing particles is exemplified. It is presumed that by forming the cross-linked structure at the substantial surface of ink absorbing particles, the molecular weight in the surface is increased, and the substantial surface of the ink absorbing particles is cured, and as a result, the durability of an image can be improved as described in the above.

From the viewpoint of forming a cross-linked structure at the substantial surface of ink absorbing particles, it is desirable that a polymer that satisfies the requirements of following (1)-(2) is contained in the ink absorbing particles:

(1) the polymer has at least neutralized polar groups as polar groups (namely, at least a part of the polar groups of (1) is neutralized); and (2) the ratio of the monomer component having the polar groups to the total monomer components is in the range of from 10% by mole to 90% by mole.

When the polar groups are anionic polar groups, for example, by applying a curable liquid containing a cationic material as the curable liquid to ink absorbing particles, it is presumed that two or more anionic polar groups form an ionic cross-linked structure by cations supplied from the cationic material. On the other hand, when the polar groups are cationic polar groups, for example, by applying a curable liquid containing a anionic material as the curable liquid to ink absorbing particles, it is presumed that two or more cationic polar groups form an ionic cross-linked structure by anions supplied from the anionic material.

For example, as a polar group, the monomer component (hereinafter, may be referred to as "polar monomer") having polar groups is a monomer containing ethyleneoxide group, carboxylic acid group, sulfonic acid group, substituted or unsubstituted amino group or hydroxyl group. For example, in the case of applying positive charge, a monomer containing (substituted) amino group or (substituted) pyridine group is preferable. In the case of applying negative charge, a monomer of an organic acid containing carboxylic acid group, sulfonic acid group or the like is preferable. In particular, in the case that carboxylic acid groups which are not neutralized (when the carboxylic acid group does not have a salt structure), the carboxylic acid groups are hard to be dissociated under the humidity in the atmosphere, but the carboxylic acid is dissociated with ink (weak alkaline liquid), and is advantageous from the viewpoint of preservation stability. Moreover, since the carboxylic acid groups are cross-linked (pseudo-cross-linkage) with ions in ink, the whole system (ink and ink absorbing particles) is easy to be fixed, so that the carboxylic acid groups are advantageous from the viewpoint of fixability.

When the ink absorbing particles have neutralized polar groups as described in (1) above, the polar groups which form salts are dissociated when ink is brought into contact with the ink absorbing particles. Accordingly, it is preferable that a cross-linked structure with reverse polar ions can be easily formed.

Moreover, as described in (2) in the above, in the polymer contained in the ink absorbing particles, when the ratio of the monomer component having polar groups to all the monomer components is 10% by mole or more, an image can be formed without inhibiting the liquid absorptivity onto the ink absorbing particles.

The ratio of the monomer component (polar monomer) having polar groups to all the monomer components is more preferably from 20% by mole to 90% by mole.

In addition, the ratio of a polar monomer can be obtained by the following manner. First, the composition of organic components is identified using analytical methods such as a mass analysis, an NMR (nuclear magnetic resonance), or an IR (infrared absorption spectra). Thereafter, in accordance with JIS K0070 or JIS K2501, the acid value and the base value of the organic components are measured. The ratio of a polar monomer can be calculated from the composition of the organic components, and the acid value/base value.

Further, whether or not at least a part of the polar groups is neutralized is confirmed by obtaining the ratio of the neutralized polar groups to all the polar monomers (monomers having polar groups). More specifically, with respect to un-neutralized portions of the polar groups, first, particles are dissolved or dispersed in water or an organic solvent, and the resultant solution or dispersion is determined by neutralizing titration with an alkali so that the concentration of the polar functional groups can be determined.

First Exemplary Embodiment

Recording Material

First, the recording material according to the first exemplary embodiment is explained in detail.

(Ink Absorbing Particles)

The ink absorbing particles in the first exemplary embodiment receive an ink component when ink contacts the particles. Here, the ink receiving means that at least a part (at least liquid component) of the ink component is held by the ink absorbing particles.

The ink absorbing particles in the first exemplary embodiment have the above constitution, so that the ink absorbing particles form ink absorbing particles capable of receiving various kinds of inks and enhancing liquid absorptivity.

As described in the above, the surface of the ink absorbing particles in the first exemplary embodiment is cured by applying a curable liquid, which will be described later, to the particles. In addition, although the embodiment is not specifically limited, as an embodiment in which the substantial surface of ink absorbing particles is cured, an embodiment in which a cross-linked structure is formed at the substantial surface of the ink absorbing particles by applying a curable liquid to the particles is exemplified.

From the viewpoint of forming a cross-linked structure at the substantial surface of the ink absorbing particles, it is desirable that an polymer that satisfies the requirements of following (1)-(2) is contained in the ink absorbing particles in the first exemplary embodiment:

(1) the polymer has at least neutralized polar groups as the polar groups (namely, at least a part of the polar groups of (1) is neutralized); and (2) the ratio of the monomer component having the polar groups to the total monomer components is in the range of from 10% by mole to 90% by mole.

In the case where the polar groups are anionic polar groups, for example, by applying a curable liquid containing a cationic material, which will described later, as a curable liquid to the ink absorbing particles, it is presumed that two or more anionic polar groups form an ionic cross-linked structure by the cations supplied from the cationic material. On the other hand, when the polar groups are cationic polar groups, for example, by applying a curable liquid containing an anionic material, which will described later, as a curable liquid, to the ink absorbing particles, it is presumed that two or more cationic polar groups form an ionic cross-linked structure by the anions supplied from the anionic material.

Next, the particle form of the ink absorbing particles in the first exemplary embodiment will be described.

The ink absorbing particles in the first exemplary embodiment may be formed of independent particles (hereinafter, may be referred to as "primary particle") of particles (hereinafter, may be referred to as "liquid absorbing particles"), or may be formed of composite particles formed by aggregating at least the liquid absorbing particles. The liquid absorbing particles contain preferably the polymer as described in the above. The independent particles of the liquid absorbing particles, or the composite particles formed by aggregating at least the liquid absorbing particles may be referred to as "mother particles".

Here, in the case where the ink absorbing particles are formed of independent particles of the liquid absorbing particles, when the ink absorbing particles absorb ink, at least the liquid component of the ink is absorbed by liquid absorbing particles, upon adhesion of the ink to the ink absorbing particles.

Thus, the ink absorbing particles receive the ink. Recording is performed by transferring the ink absorbing particles which have received the ink to a recording medium.

On the other hand, in the case of an embodiment in which ink absorbing particles are formed of composite particles formed by aggregating at least liquid absorbing particles, when the ink absorbing particles receive ink, first, the ink is adhered to the ink absorbing particles, at least the liquid component of ink is captured (trapped) by voids (hereinafter, voids among particles may be referred to as a "trap structure") among the particles (at least liquid absorbing particles) which constitute composite particles. At this time, a recording material in the ink components is adhered to or captured (trap) by the trap structure on the surface of the ink absorbing particles. In this way, the ink which exists in the voids is liquid-absorbed by the particles. Thus, the ink absorbing particles receive the ink. The ink absorbing particles which have received the ink are transferred to a recording medium to perform recording.

The capture (trap) of the ink component (liquid component, recording material) by the trap structure is a physical and/or chemical capture by the voids (physical particle wall structure) among the particles.

By using a constitution formed of composite particles formed by aggregating at least liquid absorbing particles, in addition to the capture (trap) by the voids (physical particle wall structure) among the particles that form the composite particle, the liquid component in the ink is absorbed and held by the liquid absorbing particles.

Further, after the ink absorbing particles are transferred, the component of the liquid absorbing particles that form the ink absorbing particles also functions as a binder resin and a coating resin for the recording material contained in the ink. In particular, it is desirable to use a transparent resin as a component of the liquid absorbing particles which constitute the ink absorbing particles.

Here, "the voids among the particles which constitute the composite particles", namely, the "trap structure", is a physical particle wall structure where at least a liquid can be captured. The size of the voids is, for example, in the range of from 0.1 μm to 5 μm, and preferably from 0.3 μm to 1 μm in terms of the maximum aperture. In particular, it is desirable that the voids have a size that can trap a recording material, in particular, for example, pigment having a volume average particle diameter of 100 nm. In addition, pores having a maximum aperture diameter of less than 50 nm may exist. Moreover, it is preferable that voids or capillaries are in communication with one another in the inside of the particles.

The size of the voids is determined by the following manner. An image of the surface of particles obtained by a scanning electron microscope (SEM) is read with an image analyzer, and the size and distribution of voids detected by a binary image processing are analyzed, so that the size of the voids can be obtained.

Thus, it is preferable that not only the liquid components but also the recording material in the ink components are trapped. When the recording material, in particular, pigment, in addition to the liquid components in the ink is captured (trapped) by the trap structure, the recording material can be held and fixed without the recording material being unevenly distributed in the inside of the ink absorbing particles. In addition, the liquid components in the ink are mainly an ink solvent or a dispersion medium (vehicle liquid).

Hereinafter, the particle form of the ink absorbing particles in the first exemplary embodiment will be described in more detail. As described in the above, the ink absorbing particles in the first exemplary embodiment may be formed such that the mother particles may be formed of liquid absorbing particles alone, or may be formed of composite particles formed by aggregating at least the liquid absorbing particles.

Further, other components (for example, inorganic materials) may also be contained in the liquid absorbing particles in addition to the polymers. On the other hand, particles for forming the composite particles other than the liquid absorbing particles, include, for example, inorganic particles, hydrophobic particles, releasing agent particles (wax particles), and the like.

Furthermore, for example, inorganic particles and the like may be adhered onto the surface of the liquid absorbing particles or the composite particles in the mother particles.

Figure 2:
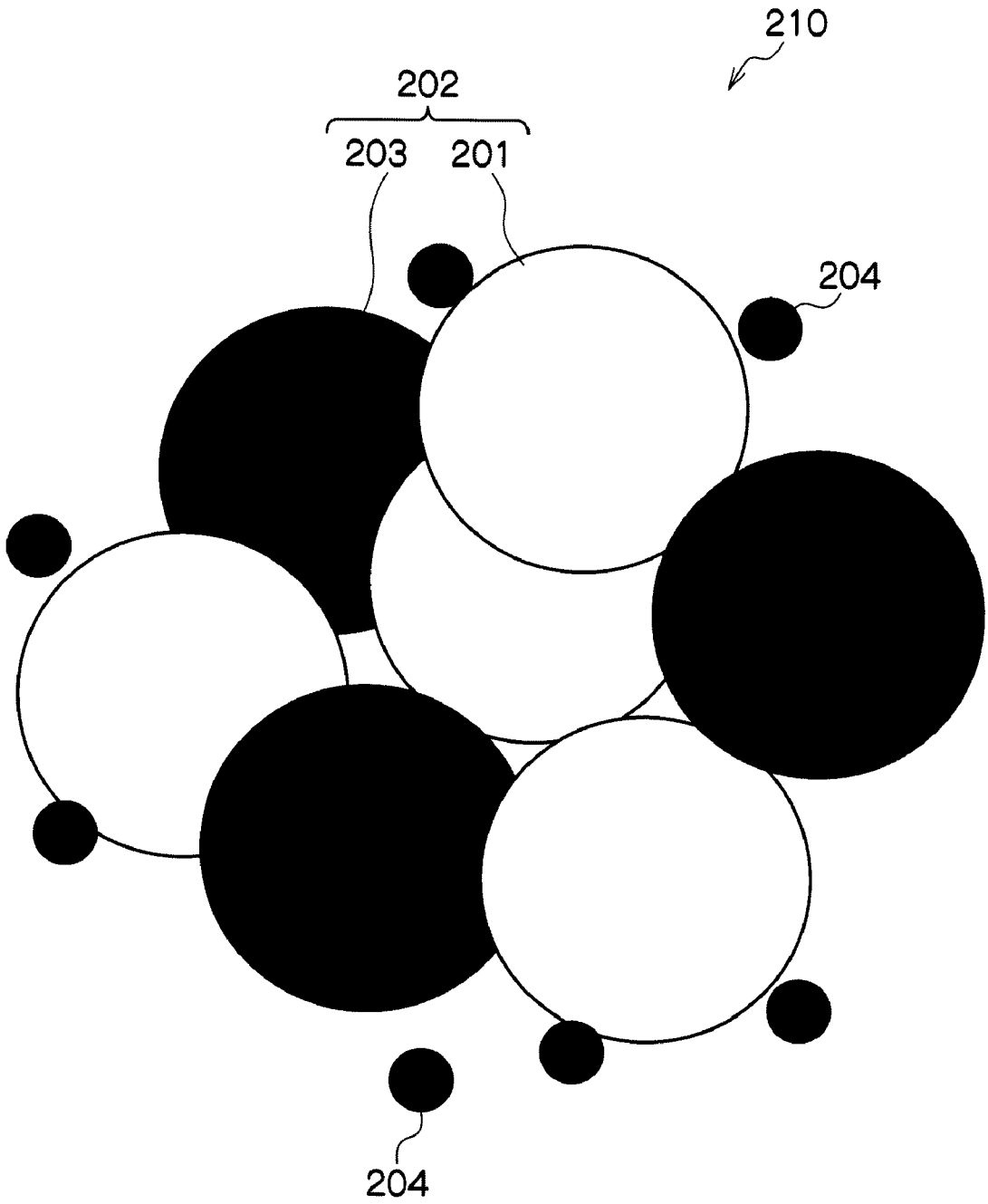
FIG. 2 is a schematic drawing showing another example of ink absorbing particles according to the first exemplary embodiment.

As a concrete constitution of the ink absorbing particles in the first exemplary embodiment, for example, as shown in FIG. 1, the constitution of ink absorbing particles 200 having a mother particle 202 formed of independent particles of liquid absorbing particles 201 and inorganic particles 204 adhered to the surface of the mother particle 202 (liquid absorbing particle 201) is exemplified. Further, as shown in FIG. 2, the constitution of ink absorbing particles 210 having the mother particles 202 formed of composite particles composed of liquid absorbing particles 201 and inorganic particles 203, and inorganic particles 204 adhered to the surface of the mother particles 202 (composite particles) is also exemplified. In addition, the composite particles have a void structure formed of voids among the particles.

Here, the sphere equivalent average particle diameter of the whole ink absorbing particles is, for example, in the range of from 0.5 μm to 50 μm.

Here, the sphere equivalent average particle diameter can be determined by the following manner. Although the optimal method varies with particle sizes, a variety of methods such as a method in which particles are dispersed in a liquid and the particle diameter is determined based on a light scattering principle, and a method in which the particle diameter is determined by the projection image of particles by image-processing can be utilized. As generally applicable methods, the microtrack UPA method and the coulter counter method can be exemplified.

When the mother particles are formed of composite particles, the mass ratio of the liquid absorbing particles to other particles (liquid absorbing particles: other particles) is, for example, in the range of from 5:1 to 1:10 in the case that the other particles are inorganic particles.

Further, the particle size of the mother particles is, for example, in the range of from 0.1 μm to 50 μm, preferably from 0.5 μm to 25 μm, and more preferably from 1 μm to 10 μm in terms of the sphere equivalent average particle diameter. When the ink absorbing particles are formed of primary particles, the sphere equivalent average particle diameter is desirable in the above range.

Furthermore, when the mother particles are formed of composite particles, the BET specific surface area ($N_2$) is, for example, in the range of from 1 $m^2/g$ to 750 $m^2/g$.

When the mother particles are formed of composite particles, for example, the composite particles are obtained by granulated in a semi-sintered state. The semi-sintered state is referred to as a state in which the particle shape remains in some degree, and voids are held among particles. Here, when the liquid component in the ink is trapped by the trap structure of the composite particles, at least a part of the composite particles is dissociated. Namely, the composite particles are disrupted, and the particles for constituting the composite particles may be parted.

When the mother particles are formed of primary particles of the liquid absorbing particles, the particle size of the liquid absorbing particles is, for example, in the range of from 0.1 μm to 50 μm, preferably in the range of from 0.5 μm to 25 μm, and more preferably in the range of from 1 μm to 10 μm in terms of the sphere equivalent average particle diameter. On the other hand, when the mother particles are formed of composite particles, the particle size of liquid absorbing particles is, for example, in the range of from 10 nm to 30 μm, preferably in the range of from 50 nm to 10 μm, and more preferably in the range of from 0.1 μm to 5 μm in terms of the sphere equivalent average particle diameter.

Further, the ratio of the liquid absorbing particles to the whole ink absorbing particles is, for example, 75% or more, preferably 85% or more, and more preferably in the range of from 90% to 99% by mass.

Hereinafter, each materials will be explained in detail.

First, a polymer (hereinafter, may be referred to as "hydrophilic polymer") is explained. As described in the above, the hydrophilic polymer is desirable to satisfy the following requirements of (1)-(2):

(1) the polymer has at least neutralized polar groups as the polar groups (namely, at least a part of the polar groups of (1) is neutralized); and (2) the ratio of the monomer component having the polar groups to the total monomer components is in the range of from 10% by mole to 90% by mole.

In addition, the polar group is contained in the polar monomer.

When the polar groups in the polymer are neutralized, a neutralizer is used. The neutralizer includes sodium hydroxide, potassium hydroxide, lithium hydroxide and the like, as an alkaline neutralizer.

On the other hand, the polar monomer containing polar groups is a monomer containing, for example, an ethylene oxide group, a carboxylic acid group, a sulfonic acid group, a substituted or unsubstituted amino group, an ammonium group and a hydroxyl group as a polar group.

For example, as an anionic polar group, a carboxylic acid group is desirable.

The ratio of the polar monomer can be obtained by the above method.

The hydrophilic polymer softens and contributes to fixability, since a liquid component (for example, water or aqueous solvent) in the ink absorbed by the hydrophilic polymer functions as a plasticizer for the resin (polymer).

The hydrophilic polymer is preferably a weak liquid absorbing polymer. The weak liquid absorbing polymer means a lyophilic polymer capable of absorbing a liquid in the range of from several % (for example, about 5%) to several hundred % (for example, about 500%), and preferably in the range of from 5% to 100% relative to the mass of the resin, for example, when the resin absorbs water.

Although the hydrophilic polymer may be formed of, for example, homopolymers of hydrophilic monomers, or copolymers of both the monomers of hydrophilic monomers and hydrophobic monomers, the copolymers are desirable in order to form a weak water absorptive polymer. Further, in addition to the monomers, a graft copolymer or a block copolymer formed by copolymerizing units such as a polymer/oligomer structure as a starting unit with other structural units may be used.

Here, the hydrophilic monomers include monomers including —OH, -EO unit (ethylene oxide group); —COOM (for example, M is a hydrogen atom, alkali metals such as Na, Li or K, ammonium, organic amine and the like); —$SO_3M$ (for example, M is a hydrogen atom, alkali metals such as Na, Li or K, ammonium, organic amine and the like); —$NR_3$ (R is, for example, a hydrogen atom, an alkyl group, a phenyl group and the like); —$NR_4X$ (R is, for example, a hydrogen atom, an alkyl group, a phenyl group and the like, and X is, for example, a halogen atom, an acid anion group such as sulfate radical, and carboxylic acid, $BF_4$ and the like). More specifically, for example, the monomers include 2-hydroxyethyl methacrylate, 2-hydroxyethyl acrylate, acrylamide, acrylic acid, methacrylic acid, unsaturated carboxylic acid, crotonic acid, maleic acid and the like. Moreover, the hydrophilic units or monomers include cellulose, cellulose derivatives such as ethyl cellulose or carboxymethyl cellulose, starch derivatives, monosaccharide derivatives, polysaccharide derivatives, vinyl sulfonic acid, styrene sulfonic acid, polymerizable carboxylic acids such as acrylic acid, methacrylic acid, maleic anhydride, or maleic acid and (partially) neutralized salts thereof; vinyl alcohols, vinyl pyrrolidone, vinyl pyridine, derivatives such as amino(meth)acrylate or dimethylamino (meth)acrylate and onium salts thereof; amides such as acrylamide or isopropyl acrylamide; polyethylene oxide chain-containing vinyl compounds and hydroxyl group-containing vinyl compounds; polyesters formed from polyfunctional carboxylic acid and polyhydric alcohol, in particular, branched polyesters which contain three or more functional acids as a constituent component such as trimellitic acid, and contain a number of terminal carboxylic acid groups and hydroxyl groups; and, polyesters including a polyethylene glycol structure.

The hydrophobic monomers include monomers having a hydrophobic group, and more specifically, for example, olefins (ethylene, butadiene and the like), styrene, α-methyl styrene, α-ethyl styrene, methyl methacrylate, ethyl methacrylate, butyl methacrylate, acrylonitrile, vinyl acetate, methyl acrylate, ethyl acrylate, butyl acrylate, lauryl methacrylate and the like. The hydrophobic unit or hydrophobic monomers include styrene, styrene derivatives such as α-methyl styrene or vinyl toluene, vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate, dialkyl maleate, polyethylene, ethylene/vinyl acetate, and polyolefins such as polypropylene, and derivatives thereof.

The liquid absorbing polymer, which is a copolymer of hydrophilic monomers and hydrophobic monomers, includes, specifically, for example, (meth)acrylates, copolymers such as styrene/(meth)acrylic acid/maleic anhydride, olefin polymers (or modified polymers thereof, or carboxylic acid unit-introduced polymers thereof by copolymerization), branched polyester with an increased acid value with trimellitic acid or the like, polyamides.

The hydrophilic polymer also contains desirably a substituted or unsubstituted amino group, and a substituted or unsubstituted pyridine group.

Here, in the hydrophilic polymer, the molar ratio (hydrophilic monomer:hydrophobic monomer) of the hydrophilic unit (hydrophilic monomer) to the hydrophobic unit (hydrophobic monomer) is, for example, from 5:95 to 70:30.

Although the hydrophilic polymer may have a straight chain structure, preferably has a branched structure. Further, the polymer is preferably non-cross-linked or low cross-linked. Furthermore, although the polymer may be random copolymers or block copolymers with a straight chain structure, polymers with branched structure (including random copolymers, block copolymers and graft copolymers with a branch structure) can be used more preferably. For example, in the case of polyesters synthesized by polycondensation, terminal end groups may be increased owing to the branched structure. The branched structure may be synthesized in a common technique such that a so-called cross-linking agent such as divinylbenzene and di(meth)acrylates (addition amount of less than 1%) is added at the time of synthesis, or a large amount of an initiator is added together with a cross-linking agent.

Further, charge control agents for electrophotographic toner such as low molecular weight quaternary ammonium salts, organic borates, and salt-forming compounds of salicylic acid derivatives may be added to the hydrophilic polymer.

The hydrophilic polymer is preferably a non-crystalline resin, and the glass transition temperature (Tg) of the resin is, for example, from 40° C. to 90° C. The glass transition temperature and the melting point are obtained from a main maximum peak measured in accordance with ASTMD3418-8. The main maximum peak can be measured by the use of DSC-7 ((trade name) manufactured by Perkin-Elmer Inc.). The melting points of indium and zinc are used for the temperature calibration of the detector of the device, and the heat of fusion is used for the calibration of the heat quantity. The measurement of samples is preformed using an aluminum pan with the use of an empty pan for the reference, at a temperature increase rate of 10° C./minute.

The weight average molecular weight of the hydrophilic polymer is, for example, from 3,000 to 300,000. The weight average molecular weight is measured under the following condition. For example, as a GPC analyzer, "HLC-8120GPC, SC-8020" ((trade name) manufactured by Tosoh Corporation) is used, as the column, two columns of "TSKgel, SuperHM-H" ((trade name) ((6.0 mmID×15 cm) manufactured by Tosoh Corporation) are used, and as an eluate, THF (tetrahydrofuran) is used. As experimental conditions, a sample concentration of 0.5%, a flow rate of 0.6 ml/minute, a sample injection quantity of 10 μl, the measurement temperature of 40° C., and an IR detector are used. Further, the calibration curves are prepared from the samples of "Polystylene Standard Sample TSK Standard", "A-500", "F-1", "F-10", "F-80", "F-380", "A-2500", "F-4", "F-40", "F-128" and "F-700" manufactured by Tosoh Corporation.

The acid value of the hydrophilic polymer is, for example, from 50 mgKOH/g to 1,000 mgKOH/g in terms of carboxylic acid groups (—COOH). The acid value in terms of the carboxylic acid group (—COOH) is measured in the following manner.

The acid value is measured using a neutralization-titration method in accordance with JIS K0070. That is, an appropriate amount of sample is fractionated, and 100 ml of a solvent (mixed solution of diethylether and ethanol) and a few drops of an indicator (phenolphthalein) are added to the fractionated sample, and the mixture is fully mixed by shaking on a water bath until the sample is dissolved. The solution is titrated with a potassium hydroxide-ethanol solution (0.1 mol/l) and the point when red color continues for 30 seconds is defined as the end point. When the acid value is defined as "A", the quantity of the sample is "S" (g), the quantity of the potassium hydroxide-ethanol solution used for titration (0.1 mol/l) is "B" (ml), and the factor of the potassium hydroxide-ethanol solution is "f", the acid value is calculated by the equation;

$$A=(B\times f\times 5.611)/S.$$

The value of "acid value×neutralization degree" of the hydrophilic polymer is preferably from 50 to 600, and more preferably from 150 to 400.

In addition, the neutralization degree is measured by the following method.

Material to be measured is neutralization-titrated with KOH to measure the quantity of (COOH), and the material after neutralization is titrated with HCl to obtain the quantity of ($COO^-$), and the neutralization degree is obtained by the equation:

$$\text{Neutralization degree}=((COO^-)-(COOH))/(COO^-).$$

More specifically, after dissolving a resin in a mixed solvent of IPA (isopropyl alcohol)/water, the consumption amount of KOH is measured in accordance with the potentiometric titration method of acid value stipulated in JIS K2501 (2003) (a potentiometer and a pH meter are used for measurement), and the amount of (COOH) (by mole) is calculated. Subsequently, the ink absorbing particles after neutralization are dissolved in the mixed solvent of IPA/water, and the solution is titrated with an aqueous solution of HCl, the consumption amount of HCl is measured in accordance with the potentiometric titration method of acid value stipulated in JIS K2501 (2003) (a potentiometer and a pH meter are used for measurement), and the amount of ($COO^-$) (by mole) is calculated. The neutralization degree is calculated from these values in accordance with the above equation.

The hydrophilic polymer explained in the above, is desirably used by adjusting the ratio of the polar monomers in the above range. Although the ink absorbing particles (liquid absorbing particles) may contain a hydrophobic polymer in addition to the hydrophilic resin, the ratio of the hydrophilic resin (including resin with salt structure and without salt structure) contained, is desirably from 80% by mass to 100% by mass with respect to the total mass of the ink absorbing particles.

Next, inorganic particles (inorganic particles which constitute composite particles together with liquid absorbing particles, and inorganic particles to be adhered to mother particles together with hydrophobic organic particles) will be explained.

As the inorganic particles, both non-porous particles and porous particles may be used. The inorganic particles include colorless, light color or white particles (for example, colloidal silica, alumina, calcium carbonate, zinc oxide, titanium oxide, tin oxide, and the like). These particles may be subjected to a surface treatment (partial hydrophobicizing treatment, specific functional group-introducing treatment and the like). For example, in the case of silica, the hydroxyl group of the silica is treated with a silylation agent such as trimethyl chlorosilane, t-butyldimethyl chlorosilane or the like to introduce an alkyl group. Dehydrogen chloride caused by the silylation agent promotes the reaction. At this time, when an amine is added, the reaction may be accelerated by converting hydrochloric acid to a hydrochloric acid salt. As the hydrophobic groups, silane coupling agents having an alkyl group or a phenyl group, or coupling agents such as titanates or zirconates are used, and the hydrophobicity may be controlled by adjusting the treatment amount or treatment conditions with the coupling agent. Further, the surface treatment with aliphatic alcohols or higher fatty acid and derivatives thereof may be possible. Furthermore, the surface treatment with coupling agents having cationic functional groups such as silane coupling agents having a (substituted) amino group or quaternary ammonium salt structure, coupling agents having a fluorine-based functional group such as fluorosilane, and coupling agents having an anionic functional group, may be possible. These inorganic particles may be contained by a so-called internal addition in the liquid absorbing particles.

Furthermore, the particle size of the inorganic particles for constituting the composite particles is, for example, from 10 μm to 30 μm, preferably from 50 nm to 10 μm, and more preferably from 0.1 μm to 5 μm in terms of the sphere equivalent average particle diameter. On the other hand, the particle size of the inorganic particles to be adhered to the mother particles is, for example, from 10 nm to 1 μm, preferably from 10 nm to 0.1 μm, and more preferably from 10 nm to 0.05 μm in terms of the sphere equivalent average particle diameter.

Although the ink absorbing particles in the first exemplary embodiment explained in the above may be used independently, the ink absorbing particles may used in combination with a carrier. As the carrier, for example, the carrier used for the developer of electrophotographic toner may be used.

(Curable Liquid)

As described in the above, the curable liquid in the first exemplary embodiment is applied to the ink absorbing particles to cure the substantial surface of the ink absorbing particles. In addition, although the curing is not specifically limited, as an embodiment for curing the substantial surface of the ink absorbing particles, an embodiment, in which a cross-linked structure is formed at the substantial surface of the ink absorbing particles, is exemplified.

From the viewpoint of forming a cross-linked structure at the substantial surface of the ink absorbing particles, the ink absorbing particle contains preferably an polymer having polar groups as described in the above. In the case where the polar groups are anionic polar groups, for example, by applying a curable liquid containing a cationic material as a curable liquid to the ink absorbing particles, it is presumed that two or more anionic polar groups form an ionic cross-linked structure by the cations supplied from the cationic material. On the other hand, when the polar groups are cationic polar groups, for example, by applying a curable liquid containing an anionic material as a curable liquid to the ink absorbing particles, it is presumed that two or more cationic polar groups form an ionic cross-linked structure by the anions supplied from the anionic material.

The cationic material contained in the curable liquid includes, for example, a polyvalent metal salt and a polyvalent amine salt.

The polyvalent amine salts include, for example, salts of secondary amines, tertiary amines and quaternary amines, as organic amines.

Moreover, for example, additives such as a viscosity adjustment agent, a water-soluble organic solvent, a dispersant or an antiseptics may be added to the curable liquid in the first exemplary embodiment in addition to the cationic materials for curing the substantial surface of ink absorbing particles.

The curable liquid is prepared by dissolving or dispersing the above components in a solvent such as water or the like.

The surface tension of the curable liquid in the first exemplary embodiment is desirably lower than that of ink, which will be described later. When the curable liquid is applied to the ink absorbing particles, the curable liquid spreads over favorably the whole surface of the ink absorbing particles owing to the lower surface tension of the curable liquid, so that the surface of the ink absorbing particles is efficiently cured.

In addition, as the values of the surface tension of the curable liquid and the ink, the values obtained using a Wilhelmy type surface tension balance (manufactured by Kyowa Interface Science Co., Ltd.) under the condition of 23° C. and 55% RH, are used.

In addition, as the physical properties of the curable liquid, the viscosity is desirably from 1.5 mPa·s to 30 mPa·s.

Here, the value of the viscosity measured at a temperature of 23° C., and at a shear rate of 1400 $s^{-1}$ by the use of LEOMAT 115 ((trade name) manufactured by Contraves) as a measuring device, is used.

In the recording apparatus according to the second exemplary and third exemplary embodiments, which will be described later, as embodiments, in which a curable liquid is applied to the ink absorbing particles, an inkjet system, an ultrasonic system, an atomizing system and a roller coat system are exemplified.

The application amount of a curable liquid is desirably from 0.1 $g/m^2$ to 5.0 $g/m^2$. Moreover, the application amount of the curable liquid with respect to the quantity of the ink absorbing particles per unit area is desirably from 1% by mass to 50% by mass.

(Ink)

The recording material according to the first exemplary embodiment includes ink. Hereafter, the ink is described in detail.

As the ink, both of aqueous ink and oily ink can be used, but aqueous ink is favorably used from the viewpoint of environmental property. The aqueous ink (hereinafter, simply referred to as "ink") contains a solvent for ink (for example, water and water-soluble organic solvent) in addition to a recording material. Further, other additives may be contained, if needed.

First, the recording material is explained. As the recording material, coloring materials are mainly used. As the coloring materials, although both dyes and pigments can be used, pigments are preferred. Both organic pigments and inorganic pigments can be used as the pigments, and black pigments include carbon black pigments such as furnace black, lamp black, acetylene black, channel black, and the like. In addition to the black pigments and the three primary color pigments of cyan, magenta and yellow colors, specific color pigments of red, green, blue, brown and white colors, metallic lustrous pigments of gold and silver colors, colorless or faint color extenders, and plastic pigments may be used. Moreover, pigments newly synthesized for the present exemplary embodiment may be used.

Further, it is possible to use, as pigments, particles formed by adhering dye or pigment to the surface of a core such as silica, alumina, and polymer beads, insoluble lake products of dye, colored emulsions and colored latexes.

Specific examples of black pigments include, RAVEN 7000 (trade names; manufactured by Columbian Chemicals Co.), REGAL 400R (trade names; manufactured by Cabot Corporation), COLOR BLACK FW1 (trade names; manufactured by Degussa Co.) and the like), but are not limited thereto.

Specific examples of cyan color pigments, include C. I. Pigment Blue-1, -2, -3, -15, -15:1, -15:2, -15:3, -15:4, -16, -22, and -60, but are not limited thereto.

Specific examples of magenta color pigments include C. I. Pigment Red-5, -7, -12, -48, -48:1, -57, -112, -122, -123, -146, -168, -177, -184, -202, and C. I. Pigment Violet-19, but are not limited thereto.

Specific examples of yellow color pigments include C. I. Pigment Yellow-1, -2, -3, -12, -13, -14, -16, -17, -73, -74, -75, -83, -93, -95, -97, -98, -114, -128, -129, -138, -151, -154, and -180, but are not limited thereto.

Here, when pigment is used as a coloring material, it is desirable to use a dispersing agent together. The usable dispersing agents include a polymer dispersant, an anionic surfactant, a cationic surfactant, an amphoteric surfactant, and a nonionic surfactant.

As the polymer dispersant, polymers having a hydrophilic structural moiety and a hydrophobic structural moiety are suitably used. As the polymer having hydrophilic structural moiety and a hydrophobic structural moiety, a condensation type polymer and an addition type polymer can be used. The condensation type polymers include known polyester type dispersants. The addition type polymers include an addition polymer of monomers having an α,β-ethylenic unsaturated group. The target polymer dispersant may be obtained by copolymerizing monomers containing an α,β-ethylenic unsaturated group having a hydrophilic group, and monomers containing an α,β-ethylenic unsaturated group having a hydrophobic group, in combination. Moreover, a homopolymer of monomers containing an α,β-ethylenic unsaturated group having a hydrophilic group may also be used.

Monomers containing an α,β-ethylenic unsaturated group having a hydrophilic group include monomers having a carboxyl group, a sulfonic acid group, a hydroxyl group, a phosphoric group, and the like. For example, acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxyethyl phosphate, bismethacryloxyethyl phosphate, methacryloxyethyl phenyl acid phosphate, ethylene glycol dimethacrylate, diethylene glycol dimethacrylate and the like are exemplified.

Monomers containing an α,β-ethylenic unsaturated group having a hydrophobic group include styrene, styrene derivatives such as α-methyl styrene and vinyl toluene, vinyl cyclohexane, vinyl naphthalene, vinyl naphthalene derivatives, an alkyl acrylate, an alkyl methacrylate, phenyl methacrylate, a cycloalkyl methacrylate, an alkyl crotonate, a dialkyl itaconate, and a dialkyl maleate.

Preferable examples of copolymers used as a polymer dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkylacrylate-acrylic acid copolymer, an alkylmethacrylate-methacrylic acid copolymer, a styrene-alkylmethacrylate-methacrylic acid copolymer, a styrene-alkylacrylate-acrylic acid copolymer, a styrene-phenyl methacrylate-methacrylic acid copolymer, and a styrene-cyclohexylmethacrylate-methacrylic acid copolymer. Moreover, monomers having a polyoxyethylene group and a hydroxyl group may be copolymerized with these polymers.

The above polymer dispersants have, for example, a weight average molecular weight of from 2,000 to 50,000.

These dispersants may be used singly, or in combination. Since the addition amount of the dispersants greatly varies with the kinds of pigments, it cannot be generalized, but the total addition amount is commonly from 0.1% by mass to 100% by mass with respect to the amount of pigments.

A self-dispersible pigment in water may also be used as a coloring material. The self-dispersible pigment in water refers to a pigment which has a number of solubilizing groups in water on the surface of the pigment and is dispersible in water without a polymer dispersant. Specifically, the self-dispersible pigment can be obtained by subjecting a generally so-called pigment to a surface modifying treatment such as an acid/base treatment, a coupling agent treatment, a polymer graft treatment, a plasma treatment and an oxidation/reduction treatment.

Further, as the self-dispersible pigment in water, in addition to the pigments which are subjected to the surface modifying treatment in the above, pigments such as CAB-O-JET-200, CAB-O-JET-300, CAB-O-JET-250, CAB-O-JET-260 and CAB-O-JET-270 (trade names; manufactured by Cabot Corporation), and MICROJET BLACK CW-1 and CW-2 (trade names; manufactured by Orient Chemical Industries, Ltd.) may be used.

The self-dispersible pigment has preferably at least a sulfonic acid, a sulfonic acid salt, a carboxylic acid, or a carboxylic acid salt as a functional group on the surface of the pigment. The self-dispersible pigment is more preferably a pigment having at least a carboxylic acid or a carboxylic acid salt as a functional group on the surface of the pigment.

Furthermore, pigment covered with a resin can also be used. The pigment is called a microcapsule pigment, and in addition to commercially available microcapsule pigments manufactured by of Dainippon Ink & Chemicals, Inc. and Toyo Ink Manufacturing Co., Ltd., microcapsule pigments experimentally prepared for the present exemplary embodiment may also be used.

Moreover, resin dispersion type pigments prepared by physically adsorbing or chemically bonding polymer materials to the above pigments may be used.

Furthermore, the recording material includes dyes such as hydrophilic anionic dyes, direct dyes, cationic dyes, reactive dyes and polymer dyes, or oil-soluble dyes, wax powder and resin powder or emulsions colored with a dye, fluorescent dyes and fluorescent pigments, infrared absorbing agents, ultraviolet absorbing agents, magnetic substances, represented by ferromagnetic substances such as ferrite and magnetite, semiconductors or photocatalysts represented by titanium oxide and zinc oxide, and other organic and inorganic electronic material particles.

The content (concentration) of the recording material is, for example, in the range of from 2% by mass to 20% by mass relative to the amount of ink.

The volume average particle diameter of the recording material is, for example, in the range of from 10 nm to 300 nm.

The volume average particle diameter of the recording material refers to the particle diameter of the recording material particles themselves, or when an additive such as a dispersant is adhered onto the recording material particles, refers to the particle diameter of the recording material particles with the additive adhered thereon. As a measuring device of the volume average particle diameter, Microtrac UPA particle size distribution analyzer 9340 (trade name; manufactured by Leeds & Northrup) is used. In the measurement, 4 ml of ink is placed in a measurement cell, and measurement is performed in accordance with a predetermined measuring method. In addition, as input values at the time of measurement, the viscosity of the ink is used as the viscosity, and the density of the recording material is used as the density of dispersed particles.

Next, the water-soluble organic solvent is explained. As the water-soluble organic solvent, polyhydric alcohols, polyhydric alcohol derivatives, nitrogen-containing solvents, alcohols, sulfur-containing solvents and the like are used.

Specific examples of the water-soluble organic solvent include polyhydric alcohols such as ethylene glycol, diethylene glycol, propylene glycol, butylene glycol, triethylene glycol, 1,5-pentanediol, and 1,2-hexanediol, 1,2,6-hexanetriol, glycerin and trimethylol propane, sugar alcohols such as xylitol, and saccharides such as xylose, glucose, and galactose.

The polyhydric alcohol derivatives include, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerin.

The nitrogen-containing solvents include pyrrolidone, N-methyl-2-pyrrolidone, cyclohexyl pyrrolidone and triethanol amine, and the alcohols include alcohols such as ethanol, isopropyl alcohol, butyl alcohol and benzyl alcohol.

The sulfur-containing solvents include thiodiethanol, thiodiglycerol, sulfolane and dimethyl sulfoxide.

Further, as a water-soluble organic solvent, propylene carbonate and ethylene carbonate can also be used.

At least one more kinds of water-soluble organic solvents may be used. The content of the water-soluble organic solvent is, for example, in the range of from 1% by mass to 70% by mass.

Next, water is explained. In order to prevent water from being contaminated with impurities, it is desirable to use ion exchange water, ultrapure water, distilled water and ultrafiltrated water.

Next, other additives are explained. A surfactant may be added to ink.

The surfactants include various kinds of anionic surfactants, nonionic surfactants, cationic surfactants and amphoteric surfactants, and anionic surfactants and nonionic surfactants are preferably used.

The surfactants may be used singly, or in combination. Further, in consideration of the solubility, for example, the hydrophilic-lipophilic balance (HLB) of the surfactant is, for example, in the range of from 3 to 20.

The addition amount of these surfactants is, for example, in the range of from 0.001% by mass to 5% by mass, and preferably in the range of from 0.01% by mass to 3% by mass.

In addition, into the ink, may be added a penetrant for the purpose of adjusting the permeability of the ink; polyethyleneimine, polyamines, polyvinyl pyrrolidone, polyethylene glycol, ethylcellulose, carboxymethyl cellulose and the like for the purpose of controlling characteristics such as the ink ejection property and the like; and alkali metal compounds such as potassium hydroxide, sodium hydroxide and lithium hydroxide for the purpose of adjusting the electroconductivity and pH value. Further, a pH buffer, an antioxidant, an antifungal agent, a viscosity controlling agent, an electroconductive agent, an ultraviolet absorber, a chelating agent, may be added to the ink, if necessary.

Next, suitable characteristics of the ink are described. First, the pH value of the ink is, for example, preferably 7 or more, more preferably from 7 to 11, and still more preferably from 8 to 10.

Here, the value of pH of ink measured with a pH and conductivity meter ((MPC227) (trade name) manufactured by Mettler Toledo) under the condition of a temperatures of 23±0.5° C. and a humidity of 55±5% R.H. is used.

The surface tension of ink is, for example, in the range of from 20 mN/m to 40 mN/m (preferably in the range of from 25 mN/m to 35 mN/m).

Here, the value of the surface tension of the ink measured by the use of a Wilhelmy type surface tension balance (manufactured by Kyowa Interface Science Co., Ltd.) under the condition of 23° C. and 55% RH is used.

The viscosity of ink is, for example, in the range of from 3 mPa·s to 15 mPa·s (preferably in the range of from 10 mPa·s to 15 mPa·s).

Here, the value of the viscosity obtained by the use of RHEOMAT 115 (trade name; manufactured by Contraves AG), under the conditions of a measurement temperature 23° C. and a shear rate of 1400 $s^{-1}$, is used.

In addition, ink is not limited to the above composition. In addition to the recording material, for example, functional materials such as a liquid crystal material or an electronic material may be included.

Second Exemplary Embodiment

Recording Apparatus

The recording apparatus according to the second exemplary embodiment contains an intermediate transfer member, an ink absorbing particle supplying unit that supplies the ink absorbing particles in the recording material according to the first exemplary embodiment onto the intermediate transfer member, an ink ejecting unit that ejects ink according to the first exemplary embodiment onto the ink absorbing particles supplied onto the intermediate transfer member, a transfer unit that transfers the ink absorbing particles that absorbed the ink onto a recording medium, a fixing unit that fixes the ink absorbing particles that absorbed the ink transferred to the recording medium, and a curable liquid application unit that applies the curable liquid in the recording material according to the first exemplary embodiment to the ink absorbing particles which have received the ink. In the recording apparatus according to the second exemplary embodiment, the curable liquid application unit applies the curable liquid to the ink absorbing particles in at least one of the following (a)-(c);

(a) after the ink is ejected to the ink absorbing particles from the ink ejecting unit, and before the ink absorbing particles that absorbed the ink are transferred to the recording medium by the transfer unit;

(b) after the ink absorbing particles that absorbed the ink are transferred to the recording medium by the transfer unit, and before the ink absorbing particles that absorbed the ink are fixed onto the recording medium by the fixing unit; and (c) after the ink absorbing particles that absorbed the ink are fixed onto the recording medium by the fixing unit.

More specifically, in the second exemplary embodiment, first, ink absorbing particles are supplied in a layered-form from an ink absorbing particle supplying unit on an intermediate body (intermediate transfer member). Ink is ejected from an ink ejecting unit onto the ink absorbing particles supplied in a layered-form (hereinafter, referred to as an ink absorbing particle layer), and the ink is received by the ink absorbing particle layer. Subsequently, an ink absorbing particle layer which has received the ink is transferred from the intermediate body to a recording medium by a transfer unit. The whole area of the ink absorbing particle layer or a recoded area (ink received area) is selectively transferred. Thereafter, the ink absorbing particle layer transferred onto the recording medium is pressurized (or heated and pressurized) by a fixing unit to be fixed. At this time, a curable liquid is applied to the ink absorbing particles, on the timing of at least any of (a)-(c) in the above. Thus, recording is performed with the ink absorbing particles which have received ink, and at the same time, the substantial surface of the ink absorbing particles is cured. In addition, the transfer and the fixation may be carried out simultaneously, or separately.

Here, when the ink absorbing particles receive the ink, the ink is received in a layered-form, and the thickness of the ink absorbing particle layer is, for example, in the range of from 1 μm to 100 μm, preferably from 3 μm to 60 μm, and more preferably 5 μm to 30 μm. Further, the porosity in the ink absorbing particle layer (namely, the porosity among the ink absorbing particles+the porosity within the ink absorbing particles (trap structure)) is, for example, in the range of from 10% to 80%, preferably from 30% to 70%, and more preferably from 40% to 60%.

Moreover, the surface of the intermediate body may be coated with a releasing agent before ink absorbing particles are supplied. The releasing agents include a (modified) silicone oil, a fluorine-based oil, a hydrocarbon oil, a mineral oil, a vegetable oil, a polyalkylene glycol, an alkylene glycol ether, an alkane diol and a molten wax.

In addition, as a recording medium, any of permeable media (for example, plain paper, coat paper or the like), non-permeable media (for example, art paper, resin film and the like), may be used. Moreover, the recording media are not restricted thereto, but industrial products such as semiconductor substrates may also be included.

Hereinafter, the recording apparatus according to the second exemplary embodiment is explained with reference to the drawings. In addition, the same denotations may be given to members having substantially the same action or function through the all drawings, and the overlapping explanations may be omitted.

Figure 3:
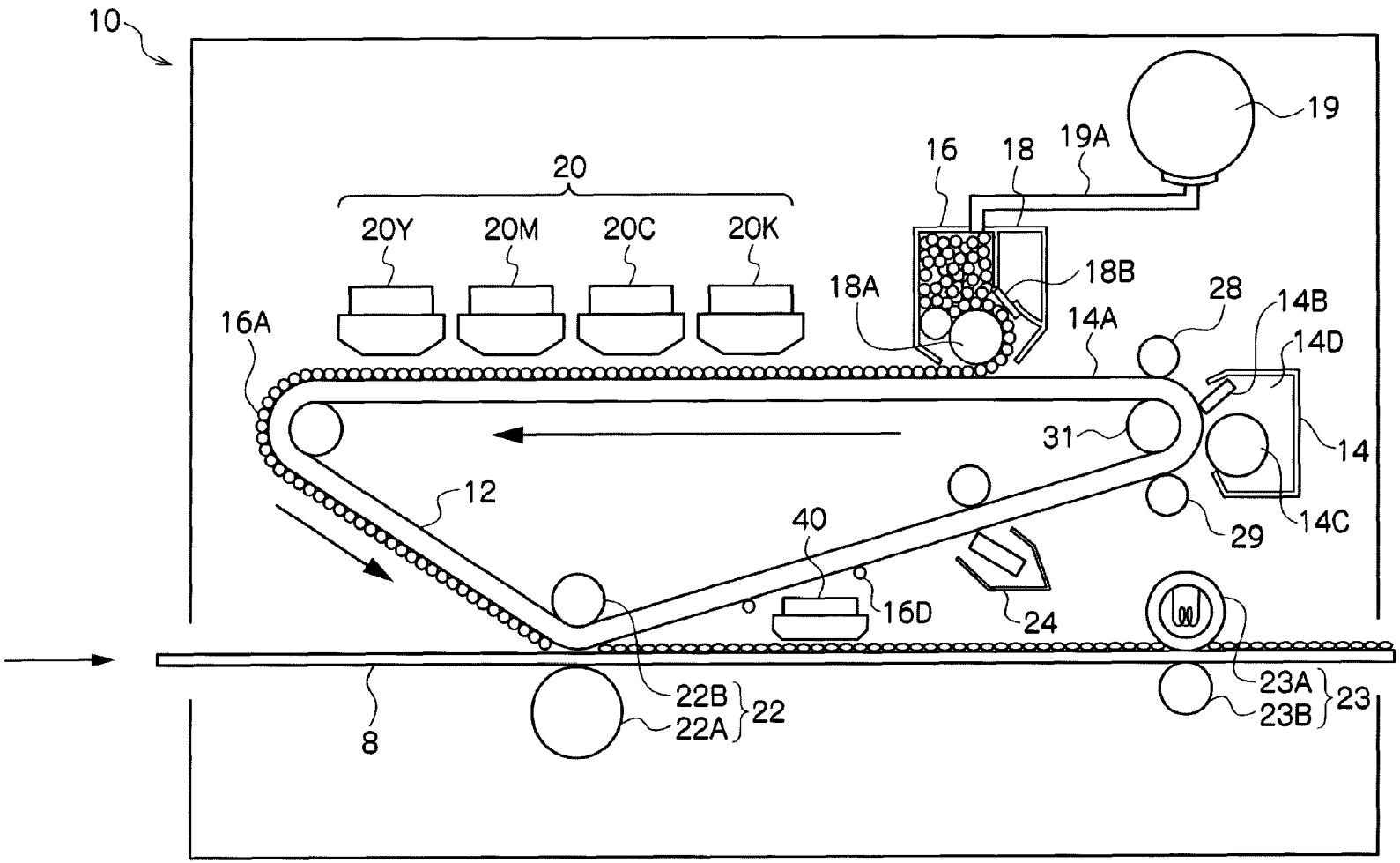
FIG. 3 is a constitutional drawing showing an example of a recording apparatus according to a second exemplary embodiment.
Figure 4:
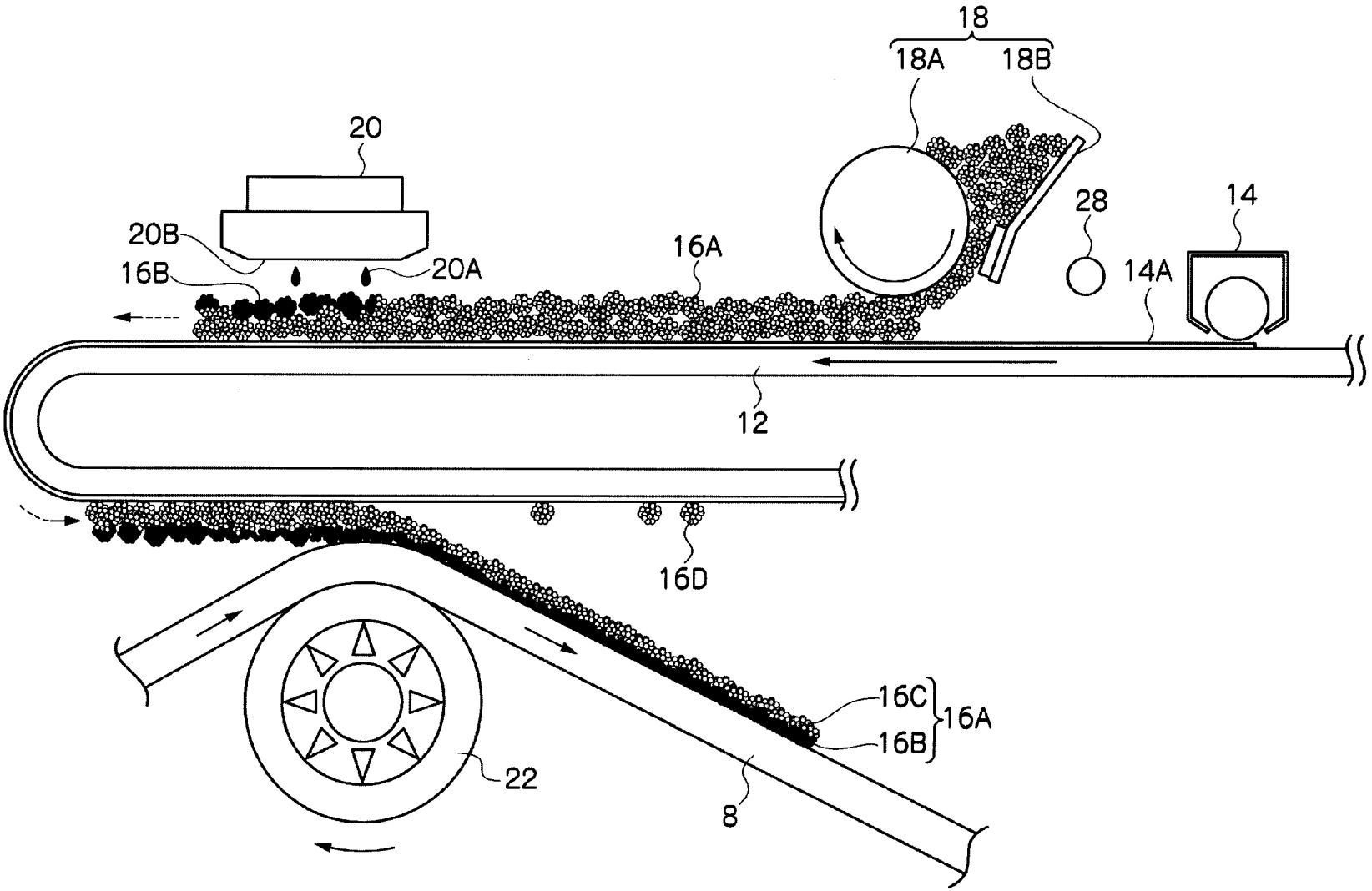
FIG. 4 is a constitutional drawing showing a principal part of an example of a recording apparatus according to the second exemplary embodiment.

FIG. 3 is a constitutional drawing showing an example of the recording apparatus according to the second exemplary embodiment. FIG. 4 is a constitutional drawing showing a principal pat of an example of the recording apparatus according to the second exemplary embodiment. FIG. 5 is a constitutional drawing showing an ink absorbing particle layer in an example of the recording apparatus according to the second exemplary embodiment. Here, examples, in which composite particles are used as the ink absorbing particles, which will be described later, are described in the following exemplary embodiments.

As sown in FIGS. 3 and 4, a recording apparatus 10 according to the second exemplary embodiment, comprises, for example, an endless belt-shaped intermediate transfer member 12, a charging device 28 for charging the surface of the intermediate transfer member 12, a particle supplying device 18 for supplying ink absorbing particles 16 to a charged area on the intermediate transfer member 12 to form a particle layer, an inkjet recording head 20 for forming an image by ejecting ink droplets to the particle layer, a transfer device 22 for transferring the ink absorbing particle layer onto a recording medium 8 by superposing the recording medium 8 on the intermediate transfer member 12, and pressurizing the superposed recording medium 8 and the intermediate transfer member 12, a curable liquid ejecting head 40 for ejecting a curable liquid onto the ink absorbing particles 16 which have been transferred, and a fixing device 23 for fixing the ink absorbing particles on the recording medium 8 by applying pressure and heat to the ink absorbing particles 16 to which the curable liquid has been applied. In addition, an ink absorbing particle accommodating cartridge 19 is detachably connected to the particle supplying device 18 via a supply pipe 19A.

A releasing agent supplying device 14 for supplying a releasing agent 14D to form a releasing layer 14A at the upstream side from the charging device 28 is disposed.

The ink absorbing particles 16 are formed in a layer by the particle supplying device 18 on the surface of the intermediate transfer member 12 charged by the charging device 28, and ink droplets with respective colors are ejected from the inkjet recording head 20, namely, from the heads 20K, 20C, 20M and 20Y, to form a color image.

The particle layer, on the surface of which a color image is formed, is transferred to the recording medium 8 for each color image with the transfer device (transfer roll) 22. A cleaning device 24 is provided at the downstream side from the transfer device 22 for removing the ink absorbing particles 16D remained on the surface of the intermediate transfer member 12, and for removing excrescence such as foreign matters (paper powder of recording medium 8 and the like) other than the ink absorbing particles adhered on the surface of the intermediate transfer member 12.

The curable liquid is applied to the ink absorbing particles 16 on the recording medium 8, on which the color image is transferred, from the curable liquid ejecting head 40, and the surface of the ink absorbing particle 16 is cured. Thereafter, the ink absorbing particles 16 together with the recording medium 8 are conveyed to the fixing device 23, pressure and heat are applied to the ink absorbing particles 16, and the ink absorbing particles 16 are fixed to the surface of the recording medium 8.

The recording medium 8, on which the ink absorbing particles 16 are fixed, is discharged in situ, and the surface of the intermediate transfer member 12 is charged again with the charging device 28. At this time, the ink absorbing particles transferred to the recording medium 8 absorb and hold the ink droplets 20A, and the recording medium 8 is discharged rapidly.

Moreover, as occasion demands, a charge elimination device 29 may be provided between the cleaning device 24 and the releasing agent supplying device 14 for eliminating residual charge remained on the surface of the intermediate transfer member 12 (hereinafter, unless otherwise specified, "between A and B", for example, means that neither A or B is included).

In the second exemplary embodiment, the intermediate transfer member 12 has a surface layer made of ethylene propylene rubber (EPDM) having a thickness of 400 μm on a base layer made of a polyimide film having a thickness of 1 mm. Preferably, the surface layer has a surface resistance of about $10^{13}\Omega/\square$, and a volume resistivity value of about $10^{12}\Omega\cdot$cm (semiconductive).

The intermediate transfer member 12 is circularly moved, and a releasing layer 14A is first formed on the surface of the intermediate transfer member 12 by the releasing agent supplying device 14. A releasing agent 14D is supplied to the surface of the intermediate transfer member 12 from a supply roll 14C in the releasing agent supplying device 14, and the layer thickness of the releasing agent is regulated with a blade 14B.

At this time, the releasing agent supplying device 14 may continuously contact the intermediate transfer member 12 in order to form and print an image continuously, or may be apart from the intermediate transfer member 12.

The releasing agent 14D may be supplied to the releasing agent supplying device 14 from an independent liquid feed system (not shown) so that the supply of the releasing agent 14D is not interrupted.

Next, positive charge is applied to the surface of the intermediate transfer member 12 with charging device 28, so that the surface of the intermediate transfer member 12 is positively charged. Here, the electric potential of the electrostatic latent image is sufficient if the ink absorbing particles 16 can be supplied to/adsorbed by the surface of the intermediate transfer member 12 by an electrostatic force due to an electric field formed by a particle supply roll 18A in an ink absorbing particle supplying device 18 and the surface of the intermediate transfer member 12.

In the second exemplary embodiment, voltage is applied between the charging device 28 and a driven roll 31 disposed at the opposite side of the intermediate transfer member 12 from the charging device 28 (connected to the ground) with the use of the charging device 28 to charge the surface of the intermediate transfer member 12.

The charging device 28 is a member having a roll shape formed by forming an elastic layer (foamed urethane resin), in which a electroconductive material is dispersed, on the peripheral surface of a rod made of stainless steel, the member being adjusted to a volume resistivity of about from $10^{6}\Omega\cdot$cm to about $10^{8}\Omega\cdot$cm. Furthermore, the surface of the elastic layer is covered with a water repellent and oil repellent cover layer (for example, formed from tetrafluoroethylene-perfluoroalkyl vinylether copolymer (PFA)) with a thickness of from about 5 μm to about 100 μm.

A DC power source is connected to the charging device 28, and the driven roll 31 is electrically connected to the flame ground. The charging device 28 is driven, while the intermediate transfer member 12 is being sandwiched between the charging device 28 and the driven roll 31, and a predetermined potential difference is generated between the charging device 28 and the grounded driven roll 31 at the contact position with the intermediate transfer member 12, and the surface of the intermediate transfer member 12 can be charged. Here, for example, a voltage of 1 kv is applied to the surface of the intermediate transfer member 12 with the charging device 28, and the surface of the intermediate transfer member 12 is charged.

Furthermore, the charging device 28 may be formed by a corotron or the like.

Next, the ink absorbing particles 16 are supplied to the surface of the intermediate transfer member 12 from the particle supplying device 18, to form an ink absorbing particle layer 16A. A supply roll 18A in the container, in which the ink absorbing particles 16 are accommodated, of the particle supplying device 18, is arranged at the portion where the supply roll 18A faces the intermediate transfer member 12, and a charging blade 18B is disposed so as to be brought into contact with the supply roll 18A. The charging blade 18B also functions for regulating the layer thickness of the ink absorbing particles 16 supplied to the surface of the supply roll 18A.

The ink absorbing particles 16 are supplied to the supply roll 18A (conductive roll), and the ink absorbing particle layer 16A is regulated by the charging blade 18B (conductive blade) and is negatively charged to the reverse polarity to the charge of the surface of the intermediate transfer member 12. As the supply roll 18A, a solid roll made from aluminum may be used, and as the charging blade 18B, a metal plate (SUS stainless steel or the like), to which urethane rubber is attached, for applying pressure, may be used. The charging blade 18B contacts the supply roll 18A with a doctor blade system.

For example, a single-layered particle layer formed from the charged ink absorbing particles 16 on the surface of the supply roll 18A is conveyed to a position facing the surface of the intermediate transfer member 12, and when the layer comes in close proximity to the position, the charged ink absorbing particles 16 are moved to the surface of the intermediate transfer member 12 by the electrostatic force due to the electric field generated by the electric potential difference between the supply roll 18A and the intermediate transfer member 12.

At this time, the moving velocity of the intermediate transfer member 12 and the revolution speed of the supply roll 18A is relatively set (peripheral speed ratio) such that the single-layered particle layer is formed on the surface of the intermediate transfer member 12. The peripheral speed ratio depends on other parameters such as the charged amount of the intermediate transfer member 12, the charged amount of the ink absorbing particles 16, or the spatial relationship of the supply roll 18A and the intermediate transfer member 12.

The number of particles supplied onto the intermediate transfer member 12 can be increased by making the peripheral speed of the supply roll 18A faster relatively on the basis of the peripheral speed ratio for forming the single-layered particle layer 16A. When the image density to be transferred is low ((low ink injecting amount), for example, from 0.1 $g/m^2$ to 1.5 $g/m^2$)), the layer thickness is set to the minimal thickness (for example, 1 μm to 5 μm), and when the image density is high ((high ink injecting amount (for example, from 4 $g/m^2$ to 15 $g/m^2$)), it is desirable to control the layer thickness (for example, from 10 μm to 25 μm) to be sufficient for holding the liquid components (solvent and dispersion medium) in the ink.

For example, in the case of a character image with a low ink injecting amount, when the image is formed on the single-layered ink absorbing particle layer on the intermediate transfer member, the image forming material (pigment) in the ink is captured by the surface of the ink absorbing particle layer on the intermediate transfer member, and the image forming material is fixed to the voids of the surface or the inside of the ink absorbing particles such that the distribution of the image forming material decreases in the depth direction.

For example, when a particle layer 16C used as a protective layer is required to be provided, the ink absorbing particle layer 16A is set to a thickness of about three layers on the image layer 166B to be a final image, and an image with the ink is formed in the top layer (refer to FIG. 5A), and the particle layer 16C corresponding to two layers which do not contribute to image formation turns into a protective layer to be formed on the image layer 166B (refer to FIG. 5B) after transfer and fixation.

Alternatively, when images with a high ink injecting amount such as a secondary color or third color image are formed, the ink absorbing particles 16 are layered such that the ink absorbing particle layer can hold the liquid component (solvent and dispersion medium) in the ink, and captures the recording material (for example, pigment), and the ink absorbing particle layer have the sufficient number of particles which do not reach the bottom layer. In this case, the image forming material (pigment) is not exposed to the surface of the image layer after transfer and fixation, and the ink absorbing particles 16 which do not contribute to image formation may be formed on the surface of the image as a protective layer.

Next, ink droplets 20A are applied to the ink absorbing particle layer 16A from the inkjet recording head 20. The ink droplets 20A are applied to the ink absorbing particle layer 16A at a predetermined position based on predetermined image information from the inkjet recording head 20.

Subsequently, the ink absorbing particle layer 16A is transferred onto the recording medium 8 by nipping the recording medium 8 and the intermediate transfer member 12 with transfer device 22, and applying a pressure to the ink absorbing particle layer 16A.

The transfer device 22 is composed of a transfer roll 22A and a pressure roll 22B on the opposite side of the intermediate transfer member 12 from the transfer roll 22A, and the transfer roll 22A and the pressure roll 22B are in contact with each other to form a contact portion. Each of the transfer roll 22A and the pressure roll 22B is formed in such a manner that an aluminum core is covered with silicone rubber, and the silicone rubber is further covered with a PFA tube.

At this time, the ink absorbing particle layer 16A is released from the releasing layer 14A formed on the surface of the intermediate transfer member 12 with pressure, and is transferred onto the recording medium 8. In addition, the intermediate transfer member 12 may be preheated at the upstream side of the transfer device 22.

Next, a curable liquid is applied to the ink absorbing particle layer 16A from a curable liquid ejecting head 40. Thus, the surface of the ink absorbing particle layer 16A (in particular, ink absorbing particle layer 16C) is cured.

Subsequently, the recording medium 8, on which the ink absorbing particle layer 16A is transferred, is nipped by the fixing device 23, and the ink absorbing particle layer 16A is pressurized and fixed onto the recording medium 8.

The fixing device 23 comprises a heating roll 23A having a heating source therein, and a pressure roll 23B opposite to the heating roll 23A, and the heating roll 23A and the pressure roll 23B are in contact with each other to form a contact portion. Each of the heating roll 23A and the pressure roll 23B may be formed in such a manner that the outer surface of an aluminum core is covered with silicone rubber, and the silicone rubber is further covered with a PFA tube.

In the contact portion of the heating roll 23A and the pressure roll 23B, the ink absorbing particle layer 16A is heated with a heater and pressurized, so that the ink absorbing particle layer 16A is fixed to the recording medium 8.

At this time, the polymer for forming the ink absorbing particles 16 in a non-image area is heated to the glass transition temperature Tg or higher, and is softened (or melted), and fixed onto the recording medium 8 with pressure. The surface of the heating roll 23A is controlled at 160° C. in this exemplary embodiment. At this time, the liquid components in the ink held in the ink absorbing particle layer 16A and the liquid component (solvent or dispersion medium) in the curable liquid are held in situ in the ink absorbing particle layer 16A, and are fixed.

In addition, as the recording medium 8, any of permeable media (for example, plain paper, coat paper or the like), non-permeable media (for example, art paper, resin film and the like), may be used. Further, the recording media are not restricted thereto, but industrial products such as semiconductor substrates may also be included.

Hereinafter, an image forming process in the recording apparatus according to the second exemplary embodiment will be described in detail. In the recording apparatus according to the second exemplary embodiment, as shown in FIG. 4, a releasing layer 14A is formed on the surface of the intermediate transfer member 12 with the releasing agent supplying device 14. In particular, if the material of the intermediate transfer member 12 is aluminum or a PET base substrate, it is desirable to form the releasing layer 14A. In addition, a releasable property may be given to the surface of the intermediate transfer member 12 by using a fluororesin or silicone rubber-based material.

Next, the surface of the intermediate transfer member 12 is charged to the reverse polarity to the charge of the ink absorbing particles 16 with the charging device 28. Thus, the ink absorbing particles 16 supplied from the supply roll 18A in the particle supplying device 18 are adsorbed electrostatically, so that a layer of the ink absorbing particles 16 can be formed on the surface of the intermediate transfer member 12.

Subsequently, the ink absorbing particles 16 are layered on the surface of the intermediate transfer member 12 using the supply roll 18A in the particle supplying device 18. For example, the formed ink absorbing particle layer 16A is formed such that the ink absorbing particles 16 have a thickness of about three layers being superposed. That is, the thickness of the ink absorbing particle layer 16A to be transferred to the recording medium 8 is controlled to a desired thickness by controlling the ink absorbing particle layer 16A by the gap between the charging blade 18B and the supply roll 18A, as described in the above. Alternatively, the thickness of the ink absorbing particle layer 16A may be controlled by the peripheral speed ratio of the supply roll 18A and the intermediate transfer member 12.

Next, the ink droplets 20A are ejected from the inkjet recording head 20 for each color driven by a piezoelectric method or a thermal method on the formed ink absorbing particle layer 16A, and an image layer 16B is formed in the ink absorbing particle layer 16A. The ink droplets 20A ejected from the inkjet recording head 20 impinge on the ink absorbing particle layer 16A, and the liquid components in the ink are promptly absorbed by the voids among the ink absorbing particles 16 and the voids for constituting the ink absorbing particles 16, and recording material (for example, pigment) is also captured by the surface of the ink absorbing particles 16 (constituting particles) or the voids among the particles for constituting the ink absorbing particles 16.

At this time, although the liquid components (solvent and dispersion medium) in the ink contained in the ink droplets 20A permeate into the ink absorbing particle layer 16A, the recording material such as pigment is captured by the surface of the ink absorbing particle layer 16A, or the voids among the particles. That is, although the liquid components (solvent and dispersion medium) in the ink may permeate into the back surface of the ink absorbing particle layer 16A, the recording material such as pigment does not permeate the back surface of the ink absorbing particle layer 16A. Accordingly, when the ink absorbing particle layer 16A is transferred to the recording medium 8, since the particle layer 16C, into which the recording material such as pigment is not permeated, form a layer on the image layer 16B, the particle layer 16C turns into a protective layer which confines the surface of the image layer 16B, and the image having the recording material (for example, coloring materials such as pigment) without being exposed to the surface can be formed.

Subsequently, the ink absorbing particle layer 16A, in which the image layer 16B has been formed, is transferred onto the recording medium 8 from the intermediate transfer member 12.

Next, a curable liquid is ejected from the curable liquid ejecting head 40 driven by a piezoelectric device, a thermal device or the like to the ink absorbing particle layer 16A on the recording medium 8. At this time, although the liquid component (solvent and dispersion medium) contained in the curable liquid permeates into the ink absorbing particle layer 16A, materials such as a cationic material or an anionic material, for curing the substantial surface of ink absorbing particles react on the surface of the ink absorbing particle layer 16A (for example, a cross-linked structure is formed in the case of a cationic material or an anionic material), and the surface of the ink absorbing particle layer 16A (in particular, the surface of the ink absorbing particle layer 16C) is cured.

Thereafter, the ink absorbing particle layer 16A on the recording medium 8 is heated and pressurized by the fixing device (fixing roll) 23 heated with heating unit such as a heater and is fixed onto the recording medium 8.

At this time, unevenness of the surface of an image may be adjusted by controlling the condition of heating and pressurization, and a glossiness may be controlled. Further, glossiness may be controlled by performing cooling-exfoliation.

The residual particles 16D remained on the surface of the intermediate transfer member 12 are recovered after the ink absorbing particle layer 16A is exfoliated by a cleaning device 24 (refer to FIG. 3), and the surface of the intermediate transfer member 12 is again charged with the charging device 28. Thereafter, the ink absorbing particles 16 are supplied, and the ink absorbing particle layer 16A is formed.

Figure 5A:
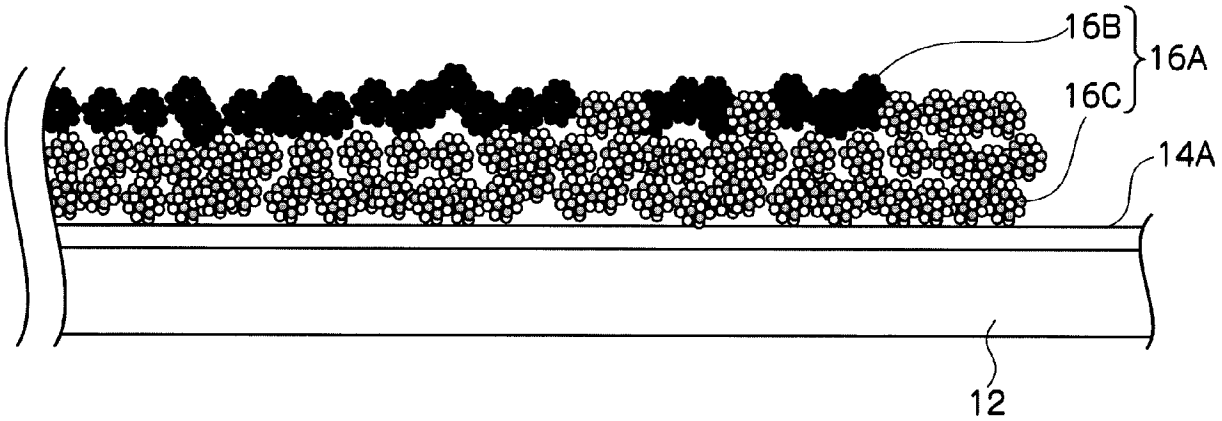
FIG. 5A is a constitutional drawing showing an ink absorbing particle layer in an example of a recording apparatus according to the second exemplary embodiment.

Here, the particle layer used for the image formation according to the second exemplary embodiment is shown in FIG. 5. As shown in FIG. 5A, a releasing layer 14A is formed on the surface of the intermediate transfer member 12.

Subsequently, the ink absorbing particles 16 are formed as a layer on the surface of the intermediate transfer member 12 using the particle supplying device 18. As described in the above, the formed ink absorbing particle layer 16A is preferably formed such that the ink absorbing particles 16 have a thickness of about three layers being superposed. The thickness of the ink absorbing particle layer 16A transferred by the recording medium 8 is controlled by controlling the ink absorbing particle layer 16A to a desired thickness. At this time, the surface of the ink absorbing particle layer 16A is leveled to such an extent that the image formation (formation of the image layer 16B) is not inhibited in the ejection of the ink droplets 20A.

Moreover, the recording material such as pigment contained in the ejected ink droplets 20A permeates into the ink absorbing particle layer 16A to the extent of a depth of from ⅓ to ½ of the thickness of the ink absorbing particle layer 16A as shown in FIG. 5A, and thereunder, the particle layer 16C, into which the recording material such as pigment does not permeate, remains.

Figure 5B:
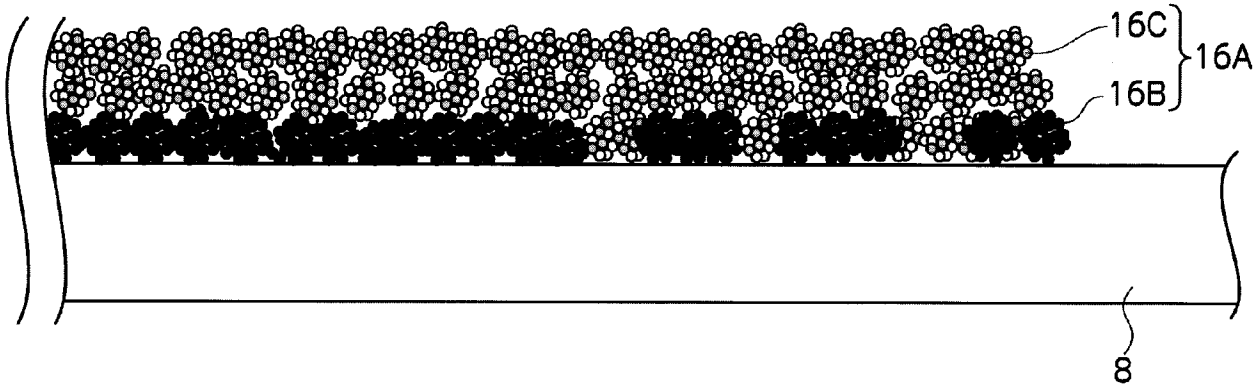
FIG. 5B is a constitutional drawing showing an ink absorbing particle layer in an example of a recording apparatus according to the second exemplary embodiment.

Since in the ink absorbing particle layer 16A formed on the recording medium 8 by pressurizing transfer with a transfer device (transfer roll) 22, the particle layer 16C, in which ink is not contained, exists on the image layer 16B as shown in FIG. 5B, and the image layer 16B is not exposed to the surface directly, the particle layer 16C serves as a protective layer. For this reason, it is necessary that the ink absorbing particles 16 at least after fixation are transparent.

Since the particle layer 16C is heated and pressurized by the fixing device (fixing roll) 23, the surface of the particle layer leveled, and the glossiness of the surface can be controlled in accordance with the degree of the heating and pressurization.

Further, the drying of the liquid component in the ink and the liquid component (solvent and dispersion medium) in the curable liquid captured in the ink absorbing particles 16 may be facilitated with heating.

The liquid component in the ink and the liquid component (solvent and dispersion medium) in the curable liquid received/held in the ink absorbing particle layer 16A, are held within the ink absorbing particle layer 16A even after the transfer fixation, and are removed by being dried naturally.

The image formation is completed through the above processes. When residual particles 16D or adhesion matters such as paper powder released from a recording medium 8 and the like remained on the surface of the intermediate transfer member 12 which are present on the surface of the intermediate transfer member 12 after the ink absorbing particles 16 are transferred to the recording medium 8, the residual particles 16D or adhesion matters may be removed with a cleaning device 24.

Further, a charge eraser device 29 may be provided at the downstream side from the cleaning device 24. For example, an electroconductive roll is used as the charge eraser device 29, the intermediate transfer member 12 is sandwiched between the charge eraser device 29 and the driven roll 31 (grounded), and a voltage of about ±3 kV with a frequency of 500 Hz is applied to the surface of the intermediated transfer body 12, so that the charge on the surface of the intermediate transfer member 12 is erased.

Since optimum conditions for the charging voltage, the thickness of the particle layer, the fixing temperature, as well as other various device conditions vary with the composition of the ink absorbing particles 16 or the ink, the ejection amount of the ink and the like, respective conditions thereof are optimized.

<Each Constituent Element>

Next, the constituent element in each step according to the second exemplary embodiment is explained in detail.

<Intermediate Transfer Member>

As described in the above, the shape of the intermediate transfer member 12, on which an ink absorbing particle layer is formed, may be a belt-shape or a cylindrical shape (drum shape). In order to supply and hold the ink absorbing particles on the surface of the intermediate transfer member with electrostatic power, it is necessary that the outer peripheral surface of the intermediate transfer member has a semiconductive, or insulative particle holding property. When the electric property of the surface of the intermediate transfer member is semiconductive, a member having a surface resistivity of from $10^{10}\Omega/\square$ to $10^{14}\Omega/\square$, and a volume resistivity of from $10^{9}\Omega\cdot$cm to $10^{13}\Omega\cdot$cm is used, and when the surface of the intermediate transfer member is insulative, a member having a surface resistivity of $10^{14}\Omega/\square$ or more, and a volume resistivity of $10^{13}\Omega\cdot$cm or more is used.

When the intermediate transfer member is belt-shaped, the belt which is formed from a substrate capable of being circularly moved as a belt in an apparatus, and has a required mechanical strength and a required heat resistance, particularly when heat is used at the time of transfer/fixation, may be used. More specifically, a polyimide, a polyamideimide, an aramid resin, polyethylene terephthalate, a polyester, a polyether sulfone, stainless steel, or the like are used.

In the case of a drum-shaped intermediate transfer member, aluminum, stainless steel, or the like may be exemplified as a substrate.

<Particle Supply Process>

First, a releasing layer 14A formed from a releasing agent 14D is formed on the surface of the intermediate transfer member 12 from the releasing agent supplying device 14 before the ink absorbing particle 16 is supplied.

As a supplying method of the releasing layer 14A, a method, in which the releasing agent 14D is supplied to a releasing agent supply member from the releasing agent supplying device 14 housing the releasing agent therein, and the releasing agent 14D is supplied to the surface of the intermediate transfer member 12 from the releasing agent supply member to form the releasing layer 14A, or a method, in which the releasing layer 14A is formed on the surface of the intermediate transfer member 12 with the use of a supply member, in which the releasing agent 14D is impregnated, may be used.

The releasing agent 14D includes releasing materials such as a silicone-based oil, a fluorine-based oil, a polyalkylene glycol or a surfactant.

The silicone-based oil includes, for example, a straight silicone oil and a modified silicone oil.

The straight silicone oil includes, for example, dimethyl silicone oil and methyl hydrogen silicone oil.

The modified silicone oil includes, for example, a methylstyryl-modified oil, an alkyl-modified oil, a higher fatty acid ester-modified oil, a fluorine-modified oil and an amino-modified oil.

The polyalkylene glycol includes polyethylene glycol, polypropylene glycol, ethyleneoxide-propyleneoxide copolymer and polybutylene glycol, and among them, polypropylene glycol is desirable.

The surfactant includes, for example, an anionic surfactant, a cationic surfactant, an amphoteric surfactant and a nonionic surfactant, and among them, a nonionic surfactant is desirable.

The viscosity of the releasing agent 14D is preferably, for example, from 5 mPa·s to 200 mPa·s, more preferably from 5 mPa·s to 100 mPa·s, and still more preferably from 5 mPa·s to 50 mPa·s.

The viscosity is measured in the following manner. The viscosity of the ink obtained is measured by the use of LEOMAT 115 ((trade name) manufactured by Contraves) as a measuring device. The measurement is performed under the condition of a temperature of 40° C., and a shear rate of 1400 $s^{-1}$.

The surface tension of the releasing agent 14D is, for example, 40 mN/m or less (preferably, 30 mN/m or less, and more preferably 25 mN/m or less).

The surface tension of the ink is measured in the following manner. The surface tension of the sample obtained is measured by the use of a Wilhelmy type surface tension balance (manufactured by Kyowa Interface Science Co., Ltd.) under the condition of 23±0.5° C. and 55±5% RH.

The boiling point of the releasing agent 14D is, for example, 250° C. or more (preferably 300° C. or more, and more preferably 350° C. or more) under 760 mmHg.

The boiling point is measured in accordance with JIS K2254 and the overpoint is used as the boiling point.

Next, the surface of the intermediate transfer member 12 is charged to the reverse polarity to the charge of the ink absorbing particles 16 with a charging device 28. The ink absorbing particle layer 16A is formed on the surface of the charged intermediate transfer member 12. At this time, a method generally used for supplying electrophotographic toner to a photoreceptor is applicable to the method of forming the ink absorbing particle layer 16A. That is, charge is beforehand supplied to the surface of the intermediate transfer member 12 with the use of a common electrophotographic charging method (charging by the charging device 28 or the like). The ink absorbing particles 16 are triboelectrically charged (monocomponent triboelectric charging system, or two-component system) to the charge with reverse polarity to the charge of the surface of the intermediate transfer member 12.

The ink absorbing particles 16 held on the supply roll 18A form an electric field with the surface of the intermediate transfer member 12, and are moved/supplied to the intermediate transfer member 12 with electrostatic power, and are held by the intermediate transfer member 12. At this time, the thickness of the ink absorbing particle layer 16A may be controlled according to the thickness of the image layer 16B (according to an amount of ink to be injected) formed in the ink absorbing particle layer 16A. At this time, the absolute value of the charging amount of the ink absorbing particles 16 is preferably in the range of from 5 μC/g to 50 μC/g.

Here, the thickness of the ink absorbing particle layer 16A is, for example, in the range of from 1 μm to 100 μm, preferably from 1 μm to 50 μm, and more preferably 5 μm to 25 μm. Further, the porosity in the ink absorbing particle layer (namely, the porosity among ink absorbing particles+the porosity within ink absorbing particles (trap structure)) is, for example, in the range of from 10% to 80%, preferably from 30% to 70%, and more preferably from 40% to 60%.

Hereinafter, the particle supply process according to a monocomponent supply (development) system will be described.

The ink absorbing particles 16 are supplied to the supply roll 18A, and the thickness of the particle layer is regulated with the charging blade 18B and the particle layer is charged.

The charging blade 18B functions to regulate the layer thickness of the ink absorbing particles 16 on the surface of the supply roll 18A, for example, the layer thickness of the ink absorbing particles 16 on the surface of the supply roll 18A is changed by changing the pressure of the charging blade 18B against the supply roll 18A. For example, the layer of the ink absorbing particles 16 on the surface of the supply roll 18A is formed in the thickness of a single layer, and the layer thickness of the ink absorbing particles 16 to be formed on the surface of the intermediate transfer member 12 is formed in the thickness of a single layer. Further, the pressure applied by the charging blade 18B is controlled to be low, and the layer thickness of the ink absorbing particles 16 formed on the surface of the supply roll 18A may be increased, so that the thickness of the ink absorbing particle layer to be formed on the surface of the intermediate transfer member 12 may be increased.

Alternatively, when the ratio of the peripheral speed of the supply roll 18A, for example, for forming a single-layered particle layer to the peripheral speed of the intermediate transfer member 12 is set to 1, the thickness of the ink absorbing particle layer on the intermediate transfer member 12 may be controlled to be increased in such a manner that the number of particles supplied onto the intermediate transfer member 12 is increased by making the peripheral speed of the supply roll 18A faster. Further, the methods in the above may be combined together for controlling the layer thickness. In the above methods, for example, the ink absorbing particles 16 are negatively charged, and the surface of the intermediate transfer member 12 is positively charged.

Thus, by controlling the layer thickness of the ink absorbing particle layer, a pattern covered with the protective layer is formed, while the consumption amount of the ink absorbing particle layer is reduced.

As the charging roll of the charging device 28, a roll having a diameter Φ of from 10 mm to 25 mm with a volume resistivity adjusted to about from $10^6$Ω·cm to about $10^8$Ω·cm, formed in such a manner that the outer peripheral surface of a member having a rod shape or a pipe shape made of materials such as aluminum or stainless steel, is covered with an elastic layer, in which a electroconductivity-imparting material is dispersed, may be used, The elastic layer is made of resin materials such as an urethane-based resin or a thermoplastic elastomer, an epichlorhydrin rubber, ethylene-propylene-dienecopolymer rubber, a silicone-based rubber, an acrylonitrile-butadiene copolymer rubber, or polynorbornene rubber. The materials are used singly, or a mixture of two or more kind thereof in combination, and a foamed urethane resin is exemplified as a desirable material.

The foamed urethane resin is preferably an urethane resin having a closed cell structure formed by mixing and dispersing hollow bodies such as hollow glass beads or thermal expansion-type microcapsules in an urethane-based resin.

Furthermore, the surface of the elastic layer may further be covered with a water-repellent cover layer having a thickness of from 5 μm to 100 μm.

A DC power source is connected to the charging device 28, and the driven roll 31 is electrically connected to the flame ground. The charging device 28 is driven, while the intermediate transfer member 12 is being sandwiched between the charging device 28 and the driven roll 31, and a predetermined potential difference is generated between the charging device 28 and the grounded driven roll 31 at the contact position with the intermediate transfer member 12.

<Marking Process>

Ink droplets 20A are ejected from the inkjet recording head 20 based on image signals, to the layer of the ink absorbing particles 16 (ink absorbing particle layer 16A) formed on the surface of the intermediate transfer member 12, and an image is formed. The ink droplets 20A ejected from the inkjet recording head 20 impinge on the ink absorbing particle layer 16A, and the ink droplets 20A are promptly absorbed by the voids among particles formed within the ink absorbing particles 16, and a recording material (for example, pigment) is captured (trapped) by the surface of the ink absorbing particle 16 or the voids among particles constituting the ink absorbing particles 16.

In this case, it is desirable that a large amount of the recording material (for example, pigment) is captured (trapped) by the surface of the ink absorbing particle layer 16A. The voids among the particles in the ink absorbing particles 16 exert the effect as a filter so that the recording material (for example, pigment) is captured (trapped) by the surface of the ink absorbing particle layer 16A and is fixed to the voids among the particles in the ink absorbing particles 16.

In order to surely trap the recording material (for example, pigment) by the surface of the ink absorbing particle layer 16A and the voids among particles in the ink absorbing particles 16, a method of insolubilizing (aggregating) the recording material (for example, pigment) rapidly by allowing to react the ink with the ink absorbing particles 16, may be used. More specifically, as the reaction, the reaction of the ink with a polyvalent metal salt, or a pH reaction type reaction, may be used.

Further, although an inkjet recording head is desirably a line type inkjet recording head having a width equivalent to, or wider than the width of a recording medium, an image may be sequentially formed on the particle layer formed on the intermediate transfer member using a conventional scan type inkjet recording head. The ink ejecting unit of the inkjet recording head 20 is not particularly restricted as far as the unit can eject ink droplets, but a unit such as a piezoelectric element driven unit or an exothermic element driven unit may be used. Although ink using a conventional dye as a colorant may be used, pigment ink is preferable.

When the ink absorbing particles 16 is allowed to react with the ink, the ink absorbing particles 16 are subjected to a treatment, in which the ink absorbing particles 16 are treated with an aqueous solution containing a flocculent (for example, a polyvalent metal salt or an organic acid) which has an effect of aggregating pigment by allowing to react the ink absorbing particles 16 with the ink, and the treated particles are dried for use.

<Transfer Process>

The ink absorbing particle layer 16A, in which an image is formed by receiving the ink droplets 20A, is transferred to the recording medium 8. In addition, the transfer process and the fixing process, which will be described hereinafter, may be simultaneously performed substantially.

An ink image is formed in the surface portion of the layer of the ink absorbing particles 16 formed on the intermediate transfer member 12 (the recording material (pigment) is trapped by the surface of the ink absorbing particle layer 16A), and transferred to the recording medium 8, so that the ink image is preferably formed in such a manner that the ink image is protected by the particle layer 16C of the ink absorbing particles 16.

<Curable Liquid Applying Process>

A curable liquid is ejected from the curable liquid ejecting head 40 to the layer (ink absorbing particle layer 16A) of the ink absorbing particles 16 transferred to the surface of the recording medium 8.

Although the curable liquid ejecting head 40 is desirably a line type liquid droplet ejecting head having a width equivalent to, or wider than the width of the recording medium 8, the liquid droplets may be sequentially ejected using a conventional scan type liquid droplet ejecting head. The liquid ejecting unit of the curable liquid ejecting head 40 is not particularly restricted as far as the unit can eject the curable liquid, but a unit such as a piezoelectric element driven unit or an exothermic element driven unit may be used.

Further, the method of applying the curable liquid onto the layer of the ink receiving layer 16 is not limited to an inkjet liquid ejecting method, but may be a method of applying a liquid using an ultrasonic wave method, an atomizing method, a roller coat method and the like.

Furthermore, the timing of applying a curable liquid is not only to the timing after the transfer process as shown in FIG. 3 and before the fixing process, but may be any of the timing of the following (a)-(c):

(a) after the ink is ejected to the ink absorbing particles from the ink ejecting unit, and before the ink absorbing particles that absorbed the ink are transferred to the recording medium by the transfer unit;

(b) after the ink absorbing particles that absorbed the ink are transferred to the recording medium by the transfer unit, and before the ink absorbing particles that absorbed the ink are fixed onto the recording medium by the fixing unit; and (c) after the ink absorbing particles that absorbed the ink are fixed onto the recording medium by the fixing unit.

Further, preferable timing is (b) or (c), and timing of (b) is more preferable.

<Fixing Process>

The ink absorbing particle layer 16A, in which an image has been formed, is fixed onto the recording medium 8 to form the image on the recording medium 8. A method of heating or pressing the ink absorbing particle layer 16A, or a method of heating and pressuring the ink absorbing particle layer 16A together, may be used for fixing the ink absorbing particle layer 16A, but the method of using both heating and pressuring is desirable.

Moreover, it is possible to control the surface physical properties of the ink absorbing particle layer 16A by controlling the heating/pressuring, and to control gloss (glossiness).

After the liquid component (solvent and dispersion medium) in the ink received/held by the layer of the ink absorbing particles 16 is transferred and fixed, the liquid component in the ink is held in the layer of the ink absorbing particles 16, and is removed by being dried naturally.

<Cleaning Process>

In order to use reiteratively the surface of the intermediate transfer member 12 by refreshing the surface, a cleaning process is desirably provided for cleaning the surface with a cleaning device 24. The cleaning device 24 is composed of a cleaning portion and a particle transport and recovery portion (not shown). In the cleaning process, the ink absorbing particles 16 remained on the surface of the intermediate transfer member 12 (residual particles 16D) are removed, and excrescence such as adhesive matters (paper powder of recording medium 8 and the like) other than the ink absorbing particles adhered onto the surface of the intermediate transfer member 12 is removed. The recovered residual particles 16D may be reused.

<Charge Erasing Process>

A charge eraser device 29 may be used for eliminating charge on the surface of the intermediate transfer member 12B prior to forming a releasing layer 14A.

Third Exemplary Embodiment

Recording Apparatus

The recording apparatus is not limited to a system using an intermediate transfer method, but another system in which ink absorbing particles are directly transferred onto a recording medium, as described hereinafter.

The recording apparatus according to a third exemplary embodiment comprises an ink absorbing particle supplying unit that supplies ink absorbing particles in the recording material according to the first exemplary embodiment onto a recording medium, an ink ejecting unit that ejects the ink in the recording material according to the first exemplary embodiment onto the ink absorbing particles supplied onto the recording medium, a fixing unit that fixes the ink absorbing particles that absorbed the ink supplied onto the recording medium, and a curable liquid application unit that applies the curable liquid in the recording material according to the first exemplary embodiment to the ink absorbing particles which have received the ink. In a recording apparatus according to the third exemplary embodiment, the curable liquid application unit applies the curable liquid to the ink absorbing particles in at least one of the following (d)-(e);

(d) after the ink is ejected to the ink absorbing particles from the ink ejecting unit, and before the ink absorbing particles that absorbed the ink are fixed onto the recording medium by the fixing unit; and (e) after the ink absorbing particles that absorbed the ink are fixed onto the recording medium by the fixing unit.

More specifically, first, ink absorbing particles are supplied to a recording medium in a layered form from a supplying unit. The ink is ejected from an ink ejecting unit to receive the ink to the ink absorbing particles (hereinafter, referred to as an ink absorbing particle layer) supplied in the layered form. The ink absorbing particles which have received the ink is pressured (or heated and pressured) to be fixed. At this time, a curable liquid is applied to the ink absorbing particles on at least any of the timing of (d) and (e) in the above. Thus, while recording with the ink absorbing particles which have received ink is performed, the substantial surface of the ink absorbing particles is cured. In this manner, the recording with the ink absorbing particles which have received ink is performed. Thus, the ink absorbing particles may be directly transferred onto the recording medium.

Figure 6:
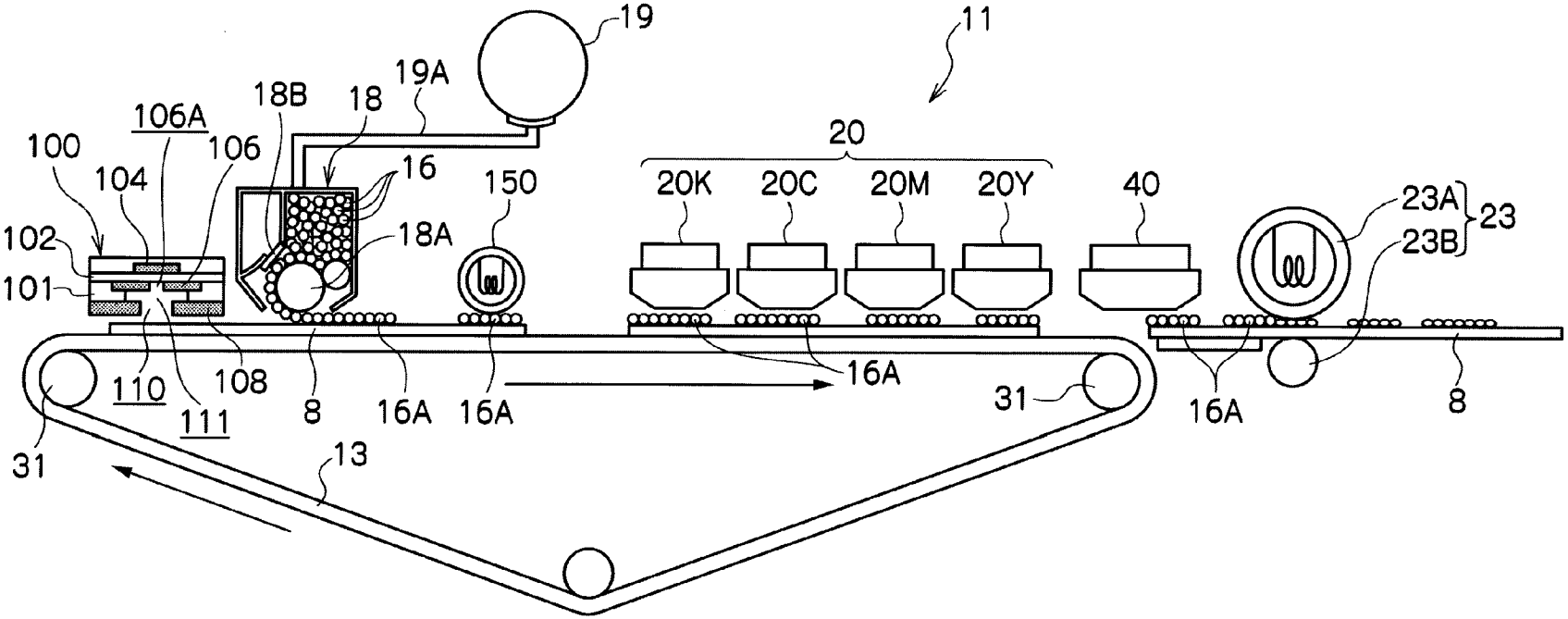
FIG. 6 is a constitutional drawing showing an example of a recording apparatus according to a third exemplary embodiment.
Figure 7:
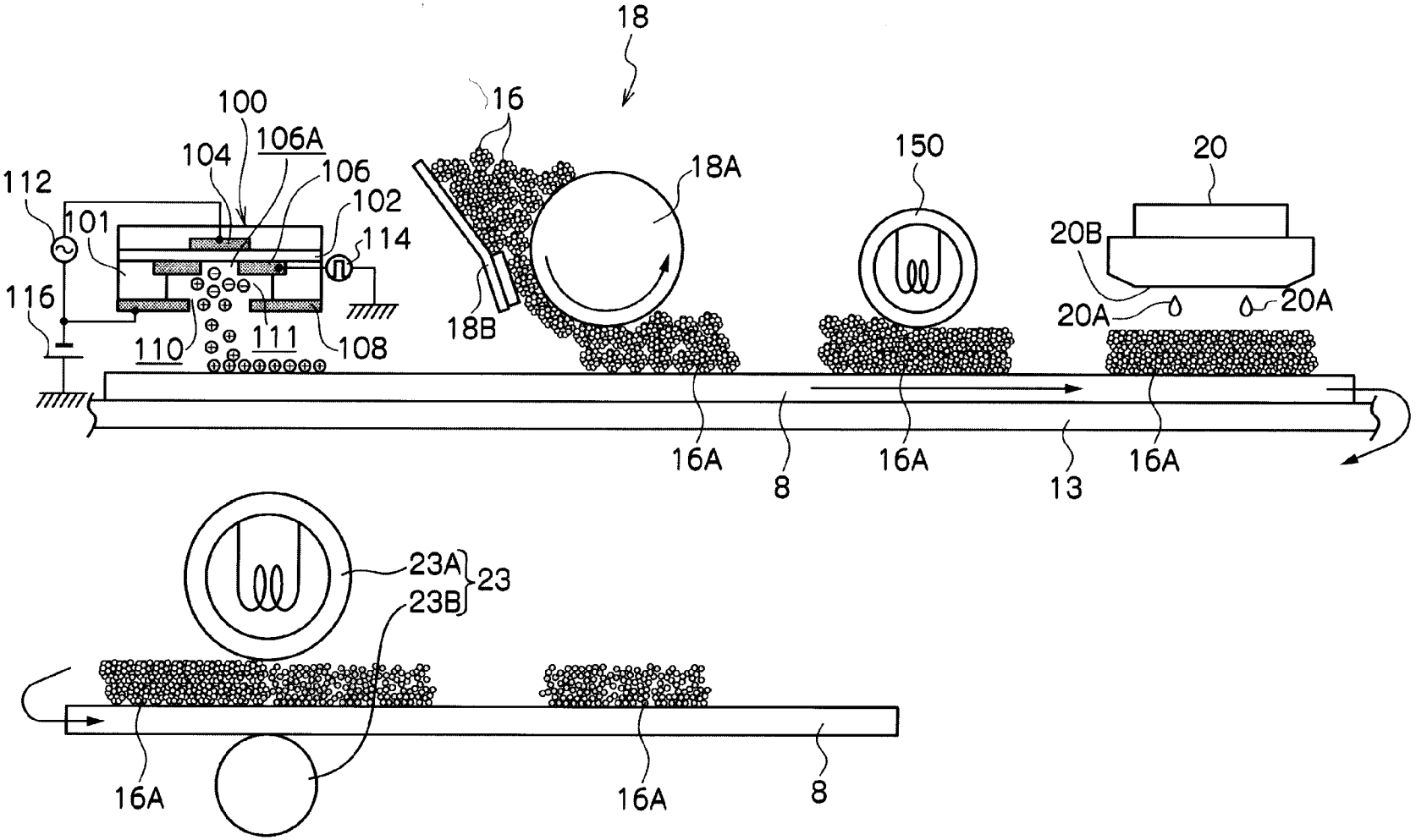
FIG. 7 is a constitutional drawing showing a principal part of an example of a recording apparatus according to the third exemplary embodiment.

FIG. 6 is a constitutional drawing showing an example of the recording apparatus according to the third exemplary embodiment. FIG. 7 is a constitutional drawing showing a main part of an example of the recording apparatus according to the third exemplary embodiment. In addition, the case where composite particles are applied as the ink absorbing particles, which will be described later, in the third exemplary embodiment is explained.

The recording apparatus 11 according to the third exemplary embodiment is equipped with an endless conveying belt 13 as shown in FIGS. 6 and 7. The conveying belt 13 is circularly moved, and conveys a recording medium 8 delivered from an accommodating container (not shown) or the like.

Figure 8A:
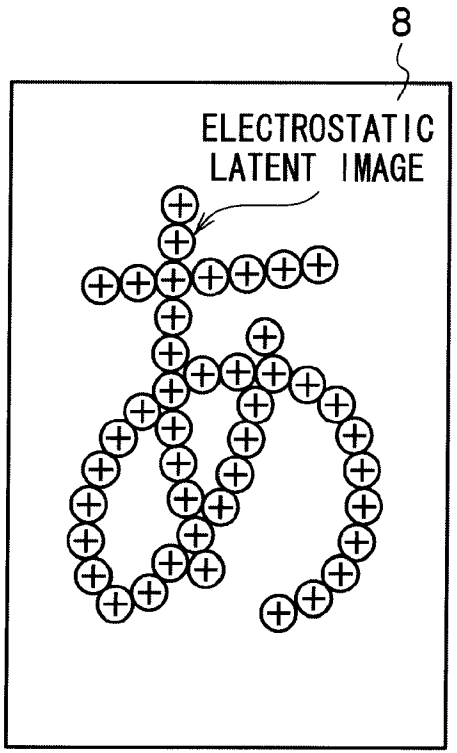
FIG. 8A is a drawing showing conceptually the steps of forming an image in the recording apparatus according to the third exemplary embodiment.

When an ion current control electrostatic recording head 100 (hereinafter, referred to as "the electrostatic recording head 100" for brevity) irradiates ion current due to electric discharge to the recording medium 8 being conveyed with the conveying belt 13 while controlling the ion current, so that an electrostatic latent image is formed on the recording medium 8 (refer to FIG. 8A).

Figure 8B:
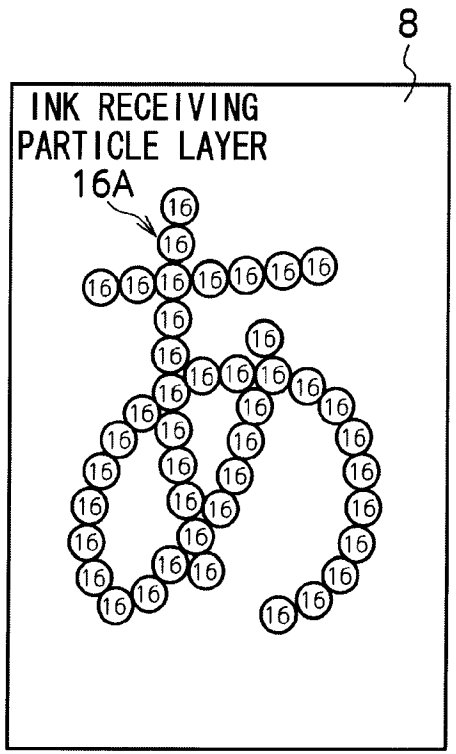
FIG. 8B is a drawing showing conceptually the steps of forming an image in the recording apparatus according to the third exemplary embodiment.

An ink absorbing particle supplying device 18 visualizes the electrostatic latent image formed on the recording medium 8, and an ink absorbing particle layer 16A composed of ink absorbing particles 16 is formed (refer to FIG. 8B).

The ink absorbing particle layer 16A formed on the recording medium 8 is preliminary heated and fixed by a preliminary fixing device 150.

Figure 8C:
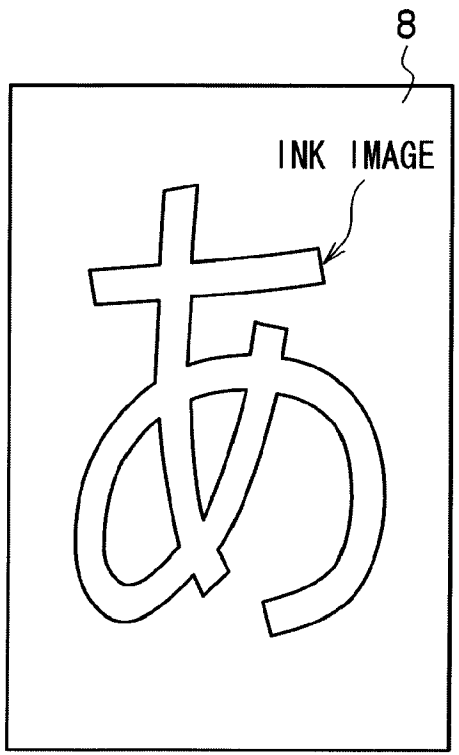
FIG. 8C is a drawing showing conceptually the steps of forming an image in the recording apparatus according to the third exemplary embodiment.

Ink droplets 20A with respective colors are ejected from recording heads 20K, 20C, 20M and 20Y corresponding to colors of black (K), cyan (C), magenta (M) and yellow (Y), to the preliminary heated, and fixed ink absorbing particle layer 16A in accordance with image data, to form an image (refer to FIG. 8C). In addition, when it is necessary to distinguish colors from one another, Y, M, C or K is attached to denotations, but Y, M, C or K may be omitted henceforth, unless distinction between colors is particularly required.

The curable liquid is applied to the ink absorbing particle layer 16A, in which the ink image has been formed, from a curable liquid ejecting head 40, and the surface of the ink absorbing particle 16 is cured. Thereafter, the ink absorbing particles 16 are conveyed to a fixing device 23 together with the recording medium 8, and pressure and heat are applied to the ink absorbing particle layer 16A, so that the ink absorbing particles 16 are fixed to the surface of the recording medium 8.

Here, each of the electrostatic recording head 100 and the inkjet recording head 20 is a line head having a width equivalent to, or wider than the width of the recording medium 8.

Next, each constitutional element, and image forming process are described in detail.

The recording medium 8 is conveyed by an endless conveying belt 13. In this embodiment, the recording medium 8 is conveyed in a state of being suctioned by the conveying belt 13.

Here, as a method of adhering the recording medium 8, for example, a method, in which the recording medium 8 is suctioned to the conveying belt 13, holes (not shown) are provided in the conveying belt 13, and the recording medium 8 is suctioned by a suction mechanism from the holes, is exemplified. In addition, a method of adhering the recording medium 8 to the conveying belt 13 may be a system using an adhesive force, or may be a system using an electrostatic adsorptive force.

The electrostatic recording head 100 for forming an electrostatic latent image on the recording medium 8 being conveyed by the conveying belt 13 is disposed at the upstream side in the conveying direction, with a gap above the recording medium 8.

In the electrostatic recording head 100, plural drive electrodes 104 are provided in parallel with each other at the front surface side of a planar rectangular insulation substrate 102, and plural control electrodes 106 are provided in such a manner that the plural control electrodes 106 intersects the drive electrodes 104 at the back surface side of the planar rectangular insulation substrate 102. In addition, a matrix (lattice) is formed by the drive electrodes 104 and the control electrodes 106. Further, circular openings 106A are formed at the positions where the drive electrodes 104 intersect the control electrodes 106. A screen electrode 108 is formed at the lower surface of the control electrodes 106 through the insulation substrate 101. In the insulation substrate 101 and the screen electrode 108, a space 111 and ion derivation openings 110 are formed at the positions corresponding to the openings 106A of the control electrode 106.

A high-frequency high voltage is applied between the drive electrodes 104 and the screen electrode 108 from an alternating-current power source 112. On the other hand, a pulse voltage corresponding to image information is applied to the control electrodes 106 from an ion control source 114. Furthermore, a direct-current voltage is applied to the screen electrode 108 from a direct-current power source 116.

When an alternating electric field is applied between the insulated drive electrodes 104 and the control electrodes 106, a creeping corona discharge is induced in the space 111, and ions generated by the creeping corona discharge are accelerated or absorbed by an electric field formed between the control electrodes 106 and the screen electrode 108, so that the discharge of an ion current from the ion derivation openings 110 is controlled, and an electrostatic latent image (see, FIG. 8A) is formed on the surface of the recording medium 8 with the ions (positive ions in this embodiment) corresponding to image signals (ink image).

The electric potential of the electrostatic latent image, in the subsequent process, is sufficient if the ink absorbing particles 16 can be supplied to/adsorbed by the recording medium 8 by an electrostatic force due to the electric field formed by a particle supply roll 18A of the ink absorbing particle supplying device 18 and the electrostatic latent image formed on the recording medium 8.

In addition, the electrostatic recording head 100 can select an area to form an electrostatic latent image. Accordingly, the electrostatic latent image formed on the surface of the recording medium 8 is set to the area to form an ink image. For example, the case where an image to be formed is a character is conceptually shown in FIG. 8A.

The recording medium 8, on the surface of which the electrostatic latent image is formed, is sent to the ink absorbing particle supplying device 18 to visualize the electrostatic latent image, and the ink absorbing particle layer 16A corresponding to the electrostatic latent image is formed (refer to FIG. 8 B). In this way, the ink absorbing particle layer 16A is formed only in the area of the ink image formed based on image signals on the recording medium 8 (the ink absorbing particle layer 16A is hardly formed in a non-image area).

Next, the image forming process is explained again.

As shown in FIG. 7, subsequently, the ink absorbing particle layer 16A formed on the recording medium 8 is subjected to preliminary fixation with a preliminary fixing device 150.

The preheating with the preliminary fixing device 150 is performed at a lower temperature than the heating temperature for fixation in a final fixing device 23. That is, the resin particles in the ink absorbing particles 16 are not completely melted and fixed with pressure by the preliminary fixing device 150, but are fixed to such an extent that bindings are formed among particles, or the particles and the surface of the recording medium while leaving voids among particles intact. Thus, the ink absorbing particle layer is preliminary fixed to the degree of capable of receiving the ink droplets 20A.

Further, a common heating and fixing device (fuser) generally used for the image forming apparatus in an electrophotographic system may be applicable to the preliminary fixing device 150. Furthermore, a heater heating method, an oven system, an electromagnetic induction heating system and the like may be used for the preliminary fixing device, in addition to the heating and fixing device used for the image forming apparatus in the electrophotographic system.

Next, the recording medium 8, on which the ink absorbing particle layer 16A is preliminary fixed, is conveyed under the inkjet recording head 20.

Thereafter, ink droplets 20A are ejected based on image data from the inkjet recording head 20, the ink droplets 20A impinge on the ink absorbing particle layer 16A formed on the surface of the recording medium 8, and an ink image is formed (FIG. 8 C). At this time, ink is received by the ink absorbing particles 16.

In addition, in order to write an image at high speed, a line type inkjet recording head having a width equal to or wider than the width of the recording medium in the present exemplary embodiment is desirable, but an image may be sequentially formed using a scan type inkjet recording head. Further, the ink ejecting unit of the inkjet liquid recording head 20 is not particularly restricted as far as the unit can eject the ink, but the unit such as a piezoelectric element driven unit or an exothermic element driven unit may be used.

Next, a curable liquid is ejected from the curable liquid ejecting head 40 driven by a piezoelectric device, a thermal device or the like to the ink absorbing particle layer 16A on the recording medium 8. At this time, although the liquid component (solvent and dispersion medium) contained in the curable liquid permeates into the ink absorbing particle layer 16A, materials such as a cationic material or an anionic material, for curing the substantial surface of the ink absorbing particles react on the surface of the ink absorbing particle layer 16A (for example, a cross-linked structure is formed in the case of a cationic material or an anionic material), and the surface of the ink absorbing particle layer 16A (in particular, the surface of the ink absorbing particle layer 16C) is cured.

Although the curable liquid ejecting head 40 is desirably a line type liquid droplet ejecting head having a width equivalent to, or wider than the width of the recording medium 8, the liquid droplets may be sequentially ejected using a conventional scan type liquid droplet ejecting head. The liquid droplet ejecting unit of the curable liquid ejecting head 40 is not particularly restricted as far as the unit can eject the curable liquid, but a unit such as a piezoelectric element driven unit or an exothermic element driven unit may be used.

Further, the method of applying the curable liquid onto the layer of the ink receiving layer 16 is not limited to an inkjet liquid ejecting method, but may be a method of applying liquid using an ultrasonic wave method, an atomizing method, a roller coat method and the like.

Further, in the recording apparatus as shown in FIG. 6, although the curable liquid is applied to the ink absorbing particle layer, after an ink image is formed by the inkjet recording head 20 and before the ink image is fixed by the fixing device 23, the timing of applying the curable liquid is not limited to this timing. The timing may be any of the following timing (d) and (e), but the timing of (d) is preferable:

(d) after the ink is ejected to the ink absorbing particles from the ink ejecting unit, and before the ink absorbing particles that absorbed the ink are fixed onto the recording medium by the fixing unit; and (e) after the ink absorbing particles that absorbed the ink are fixed onto the recording medium by the fixing unit.

Next, after the recording medium 8 is exfoliated from the conveying belt 13, the recording medium 8 is sent to the fixing device 23, and pressure and heat are applied to the ink absorbing particle layer 16A to fix the ink absorbing particle layer 16A onto the recording medium 8.

The fixing device 23 comprises a heating roll 23A having a heating source therein, and a pressure roll 23B opposite to the heating roll 23A, and the heating roll 23A and the pressure roll 23B are in contact with each other to form a contact portion. Each of the heating roll 23A and the pressure roll 23B is formed in such a manner that the outer surface of an aluminum core is covered with silicone rubber, and the silicone rubber is further covered with a PFA tube. This constitution is similar to the fixing device (fuser) generally used for the image forming apparatus in the electrophotographic system. Furthermore, a heater heating method, an oven system, an electromagnetic induction heating system and the like may be used for the fixing device, in addition to the heating and fixing device used for the image forming apparatus in the electrophotographic system.

When the recording medium 8 passes through the contact portion between the heating roll 23A and the pressure roll 23B, the ink absorbing particle layer 16A is heated and pressurized, and the ink absorbing particle layer 16A is fixed to the recording medium 8. Further, instead of the method of using heating and pressurization together, a method of using only heating or pressurization may be used, but the method of using both heating and pressurization is desirable.

Image formation is completed through the above processes, and the recording medium 8 is discharged from the apparatus.

The third exemplary embodiment is similar to the second exemplary embodiment except the above explanations in relation to the third exemplary embodiment, and other explanations are omitted.

In the second and third exemplary embodiments, although ink droplets are selectively ejected from the inkjet recording head 20 for each color of black, yellow, magenta and cyan based on image data to form a full color image, the present exemplary embodiment is not limited to record characters or images onto the recording medium 8. That is, the liquid droplet ejecting device according to the present exemplary embodiment is generally applicable to liquid droplet ejecting (injecting) devices used industrially.

Image may be formed by utilizing the recording apparatus of the invention according to the following exemplary methods.

<1> A recording apparatus comprising: an intermediate transfer member; an ink absorbing particle supplying unit that supplies ink absorbing particles to the intermediate transfer member; an ink ejecting unit that ejects ink to the ink absorbing particles supplied onto the intermediate transfer member; a transfer unit that transfers the ink absorbing particles that absorbed the ink to a recording medium; a fixing unit that fixes the ink absorbing particles that absorbed the ink transferred to the recording medium; a curable liquid application unit that applies a curable liquid to the ink absorbing particles that have received the ink; the curable liquid curing the substantial surface of the ink absorbing particles.

The recording method according to <1>, wherein the curable liquid application unit applies the curable liquid under a condition selected from at least the following (a)-(c):

(a) after the ink is ejected to the ink absorbing particles from the ink ejecting unit, and before the ink absorbing particles that absorbed the ink are transferred to the recording medium by the transfer unit;

(b) after the ink absorbing particles that absorbed the ink are transferred to the recording medium by the transfer unit, and before the ink absorbing particles that absorbed the ink are fixed onto the recording medium by the fixing unit; and (c) after the ink absorbing particles that absorbed the ink are fixed onto the recording medium by the fixing unit.

The recording method according to <1>, wherein the curable liquid is a liquid that forms a cross-linked structure at the substantial surface of the ink absorbing particles.

The recording method according to <1>, wherein the ink absorbing particles include a polymer containing a neutralized polar group, and in which the ratio of a monomer component having a polar group to the total monomer components is in the range of from 10% by mole to 90% by mole.

<2> A recording method comprising: an ink absorbing particle supplying unit that supplies ink absorbing particles onto a recording medium; an ink ejecting unit that ejects ink to the ink absorbing particles supplied onto the recording medium; a fixing unit that fixes the ink absorbing particles that absorbed the ink supplied onto the recording medium; and a curable liquid application unit that applies a curable liquid to the ink absorbing particles that have received the ink; the curable liquid curing the substantial surface of the ink absorbing particles.

The recording method according to <2>, wherein the curable liquid application unit applies the curable liquid under a condition selected from at least the following (d)-(e):

(d) after the ink is ejected to the ink absorbing particles from the ink ejecting unit, and before the ink absorbing particles that absorbed the ink are fixed onto the recording medium by the fixing unit; and (e) after the ink absorbing particles that absorbed the ink are fixed onto the recording medium by the fixing unit.

The recording method according to <2>, wherein the curable liquid is a liquid that forms a cross-linked structure at the substantial surface of the ink absorbing particles.

The recording method according to <2>, wherein the ink absorbing particles include a polymer containing a neutralized polar group, and in which the ratio of a monomer component having a polar group to the total monomer components is in the range of from 10% by mole to 90% by mole.

EXAMPLES

Hereinafter, the invention will be described with reference to examples in detail. However, the invention is not limited to the examples.

<Production of Ink Absorbing Particles>

(Ink Absorbing Particles A)

First, styrene/n-butylmethacrylate/methacrylic acid copolymer (polar monomer ratio 33% by mole) is neutralized with sodium hydroxide to form particles (the degree of acid value×neutralization degree is 180).

Subsequently, 100 parts by mass of the above particles and 2 parts by mass of amorphous silica (AEROSIL TT600 (trade name) manufactured by Degussa) are mixed and stirred to obtain particles having a sphere equivalent average particle diameter of 6 μm.

(Ink Absorbing Particles B)

First, styrene/n-butylmethacrylate/methacrylic acid copolymer (polar monomer ratio 60% by mole) is neutralized with sodium hydroxide to form particles (the degree of acid value×neutralization degree is 300).

Subsequently, 95 parts by mass of the above particles, 5 parts by mass polyester particles and 2 parts by mass of amorphous silica (AEROSIL TT600 (trade name) manufactured by Degussa) are mixed and stirred to obtain particles having a sphere equivalent average particle diameter of 8 μm.

(Ink Absorbing Particles C)

First, styrene/n-butylmethacrylate/methacrylic acid copolymer (polar monomer ratio 12.5% by mole) is neutralized with sodium hydroxide to form particles (the degree of acid value×neutralization degree is 70).

Subsequently, 100 parts by mass of the above particles and 2 parts by mass of amorphous silica (AEROSIL TT600 (trade name) manufactured by Degussa) are mixed and stirred to obtain particles having a sphere equivalent average particle diameter of 8 μm.

(Ink Absorbing Particles D)

First, styrene/n-butylmethacrylate/methacrylic acid copolymer (polar monomer ratio 87.5% by mole) is neutralized with sodium hydroxide to form particles (the degree of acid value×neutralization degree is 450).

Subsequently, 90 parts by mass of the above particles, 10 parts by mass of polyester particles and 2 parts by mass of amorphous silica (AEROSIL TT600 (trade name) manufactured by Degussa) are mixed and stirred to obtain particles having a sphere equivalent average particle diameter of 9 μm.

(Ink Absorbing Particles E)

First, styrene/n-butylmethacrylate/methacrylic acid copolymer (polar monomer ratio 82% by mole) is neutralized with sodium hydroxide to form particles (the degree of acid value×neutralization degree is 220).

Subsequently, 90 parts by mass of the above particles, 10 parts by mass of polyester particles and 2 parts by mass of amorphous silica (AEROSIL TT600 (trade name) manufactured by Degussa) are mixed and stirred to obtain particles having a sphere equivalent average particle diameter of 10 μm.

(Ink Absorbing Particles F)

First, styrene/n-butylmethacrylate/methacrylic acid copolymer (polar monomer ratio 8% by mole) is neutralized with sodium hydroxide to form particles (the degree of acid value×neutralization degree is 40).

Subsequently, 100 parts by mass of the above particles and 2 parts by mass of amorphous silica (AEROSIL TT600 (trade name) manufactured by Degussa) are mixed and stirred to obtain particles having a sphere equivalent average particle diameter of 6 μm.

The "polar monomer ratio" in the ink absorbing particles A-F is measured as follows:

First, the composition of organic components is identified by analytical methods such as a mass analysis, an NMR (nuclear magnetic resonance), or an IR (infrared absorption spectra). Thereafter, in accordance with JIS K0070 or JIS K2501, the acid value and the base value of the organic components are measured. The ratio of a polar monomer is calculated from the composition of the organic components, and the acid value/base value.

<Production of Curable Liquid>

| (Curable liquid 1) | |
|---|---|
| glycerin | 30% by weight |
| propylene glycol | 5% by weight |
| 1,2-hexanediol | 2% by weight |
| OLFINE E1010 ((trade name) manufactured by Nisshin Chemical Industry Co., Ltd.) | 1.5% by weight |
| magnesium nitrate hexahydrate (cationic material) | 2% by weight |
| water | (Balance) |

The above components are mixed and stirred to obtain a curable liquid.

| (Curable liquid 2) | |
|---|---|
| diglycerin-EO adduct | 30% by weight |
| diethylene glycol | 10% by weight |
| 1,2-hexanediol | 5% by weight |
| OLFINE E1010 ((trade name) manufactured by Nisshin Chemical Industry Co., Ltd.) | 1% by weight |
| calcium nitrate (cationic material) | 4% by weight |
| water | (Balance) |

The above components are mixed and stirred to obtain a curable liquid.

| (Curable liquid 3) | |
|---|---|
| diglycerin-EO adduct | 30% by weight |
| propylene glycol | 10% by weight |
| diethylene glycol monobutyl ether | 5% by weight |
| OLFINE E1010 ((trade name) manufactured by Nisshin Chemical Industry Co., Ltd.) | 0.75% by weight |
| diethanol amine (cationic material) | 6% by weight |
| water | (Balance) |

The above components are mixed and stirred to obtain a curable liquid.

<Production of Ink>

| (Ink I) | |
|---|---|
| CABOJET 200 (self-dispersible ink) | 5% by weight |
| glycerin | 20% by weight |
| triethylene glycol | 5% by weight |
| propylene glycol | 2% by weight |
| OLFINE E1010 ((trade name) manufactured by Nisshin Chemical Industry Co., Ltd.) | 1% by weight |
| water | (Balance) |

The above components are mixed and stirred to obtain an ink.

| (Ink II) | |
|---|---|
| C.I. Pigment Blue 15:3 (resin-dispersed ink) | 5% by weight |
| styrene/n-butylmethacrylate/methacrylic acid | 2% by weight |
| glycerin | 20% by weight |
| triethylene glycol | 5% by weight |
| diethylene glycol mono-butyl ether | 2% by weight |
| OLFINE E1010 ((trade name) manufactured by Nisshin Chemical Industry Co., Ltd.) | 0.75% by weight |
| water | (Balance) |

The above components are mixed and stirred to obtain an ink.

| (Ink III) | |
|---|---|
| C.I. Pigment Blue 15:3 (resin-dispersed ink) | 4% by weight |
| styrene/n-butylmethacrylate/methacrylic acid | 2.5% by weight |
| glycerin | 20% by weight |
| propylene glycol | 5% by weight |
| 1,2 hexane diol | 5% by weight |
| OLFINE E1010 ((trade name) manufactured by Nisshin Chemical Industry Co., Ltd.) | 0.1% by weight |
| water | (Balance) |

The above components are mixed and stirred to obtain an ink.

Examples 1-9 and Comparative Example 1

<Image Formation>

The ink absorbing particle storage cartridge 19 is filled with the ink absorbing particles shown in the following table 1, using the recording apparatus as shown in FIG. 3, and the ink absorbing particle layer 16A is formed on the intermediate transfer member 12 in the application amount as shown in the following table 1. Subsequently, the ink as shown in the following table 1 using only one recording head in the inkjet recording heads 20 is ejected in the application amount as shown in the following table 1. After transferring the ink absorbing particle layer 16A to the recording medium 8, curable liquids as shown in the following table 1 from the curable liquid ejecting head 40 are ejected in the application amount as shown in the following table 1, and the images are formed through the fixing process.

[Evaluation]

—Rubfastness—

The fixability when fixation is performed at 100° C. is evaluated as follows.

A blank sheet of plain paper (C2 paper, manufactured by Fuji Xerox Co., Ltd.) and a weight having a bottom area of 10 $cm^2$ and 5 Kg by weight thereon are placed on the printed area of a print, and the blank sheet is pulled in the direction of non-printed area. After removing the blank sheet and the weight, the degree of transfer of ink to the non-printed area is checked and sensorially assessed with reference to boundary samples. The evaluation criteria are as follows:

A: ink transfer is not observed;

B: ink transfer is slightly observed at the microscopic level;

C: ink transfer is slightly observed visually; and

D: ink transfer is observed.

—Water Resistance—

One drop of water is dropped on a printed image of a recording medium, and the recording medium is raised upright at an angle of 90° and the disruption of an image (flow of ink) is sensorially assessed. The evaluation criteria are as follows:

A: blur of image is not observed at the microscopic level;

B: blur of image is not observed visually, but is slightly observed at the microscopic level;

C: blur of image is not observed visually, but is observed at the microscopic level; and D: when a recording medium is leaned, an image is disrupted.

—Liquid Absorption Time—

Ink absorbing particles (particle; 30 $g/m^2$) are sprayed on a PFA film. Ink with 2 μL per one drop is applied on the ink absorbing particles to form a coverage pattern of 100% at an image density of 1,200 dpi×1,200 dpi with use of an inkjet method.

A sheet of plain paper (C2 paper) is pressed against the image surface at a pressure of $10^5$ Pa, and time until ink is not transferred to the plain paper is measured.

A: drying time is less than 0.25 second;

B: drying time is from 0.25 second to less than 0.75 second; and

C: drying time is 0.75 seconds or more.

TABLE 1

| | Ink absorbing particle | | | | Ink | | Curable liquid | | | Evaluation | | |
|---|---|---|---|---|---|---|---|---|---|---|---|---|
| | Kind | Applied Amount ($g/m^2$) | Ratio of Polar Monomer (% by mol) | Acid Value × Neutralization | Liquid | Applied Amount ($g/m^2$) | Liquid | Applied Amount ($g/m^2$) | Ratio (%) | Rubfastness | Water Resistance | Liquid Absorbing Time |
| Example 1 | A | 10 | 33 | 180 | I | 5 | 1 | 1.5 | 15 | A | A | A |
| Example 2 | A | 5 | 33 | 180 | I | 5 | 2 | 0.25 | 5 | B | B | A |
| Example 3 | B | 10 | 60 | 330 | I | 7 | 2 | 2.8 | 28 | B | B | A |
| Example 4 | C | 10 | 12.5 | 70 | II | 8 | 3 | 0.4 | 4 | C | B | B |
| Example 5 | D | 15 | 87.5 | 450 | III | 10 | 1 | 5.2 | 34.67 | C | C | A |
| Example 6 | E | 7 | 82 | 220 | II | 5 | 2 | 1.1 | 15.71 | A | A | A |
| Example 7 | D | 15 | 87.5 | 450 | III | 7 | 1 | 5.2 | 34.67 | C | C | A |
| Example 8 | C | 15 | 12.5 | 70 | I | 10 | 3 | 0.1 | 0.67 | C | C | B |
| Example 9 | F | 10 | 8 | 40 | II | 5 | 3 | 0.1 | 1 | C | B | B |
| Comparative Example 1 | C | 7 | 12.5 | 70 | II | 7 | — | | — | D | D | B |

Note:

The ratio represents the ratio of the applied amount of curing resin to the applied amount of ink absorbing particles.

What is claimed is:

1. A recording material comprising:

an ink, ink absorbing particles that absorb the ink, and a curing liquid that cures the substantial surface of the ink absorbing particles, wherein the ink absorbing particles include inorganic particles and a polymer that contains a neutralized polar group, and in the polymer, the ratio of a monomer component having a polar group to the total monomer components is in the range of from 10% by mole to 90% by mole, wherein the polar group is an anionic polar group, and the curing liquid contains a cationic material that is at least one selected from polyvalent metal salts and polyvalent amine salts.

2. The recording material according to claim 1, wherein the curing liquid is a liquid that forms a cross-linked structure at the substantial surface of the ink absorbing particles.

3. The recording material according to claim 1, wherein the anionic polar group is a carboxylic group.

4. The recording material according to claim 1, wherein the surface tension of the curing liquid is lower than the surface tension of the ink.

* * * * *